US008564484B2

(12) United States Patent
Jan et al.

(10) Patent No.: US 8,564,484 B2
(45) Date of Patent: Oct. 22, 2013

(54) PLANAR DUAL POLARIZATION ANTENNA

(75) Inventors: Cheng-Geng Jan, Hsinchu (TW); Chang-Hsiu Huang, Hsinchu (TW); Chieh-Sheng Hsu, Hsinchu (TW)

(73) Assignees: Wistron NeWeb Corporation, Hsinchu Science Park, Hsinchu (TW); Cheng-Geng Jan, Hsinchu Science Park, Hsinchu (TW)

( * ) Notice: Subject to any disclaimer, the term of this patent is extended or adjusted under 35 U.S.C. 154(b) by 253 days.

(21) Appl. No.: 13/116,013

(22) Filed: May 26, 2011

(65) Prior Publication Data

US 2012/0212376 A1 Aug. 23, 2012

(30) Foreign Application Priority Data

Feb. 22, 2011 (TW) ..... 100105757 A

(51) Int. Cl.
*H01Q 1/32* (2006.01)

(52) U.S. Cl.
USPC ..... 343/700 MS; 343/711

(58) Field of Classification Search
USPC ..... 235/700 MS, 711, 712, 713, 725, 729; 343/700 MS, 711, 712, 713, 725, 729
See application file for complete search history.

(56) References Cited

U.S. PATENT DOCUMENTS 5,706,015 A * 1/1998 Chen et al. ..... 343/700 MS
2007/0229359 A1* 10/2007 Heyde ..... 343/700 MS

* cited by examiner

*Primary Examiner* — Karl D Frech
(74) *Attorney, Agent, or Firm* — Winston Hsu; Scott Margo

(57) ABSTRACT

A planar dual polarization antenna for receiving and transmitting radio signals includes a ground metal plate, a first dielectric board formed on the ground metal plate, and a first patch plate formed on the first dielectric board with a shape substantially conforming to a cross pattern.

11 Claims, 34 Drawing Sheets

| Frequency | Maximum gain | 3dB beamwidth | Front-to-back ratio | Co/Cx |
|---|---|---|---|---|
| 746(MHz) | 5.74dBi | 77 deg | 10.1dB | 22.3dB |
| 756(MHz) | 6.23dBi | 77 deg | 10.6dB | 22.3dB |
| 777(MHz) | 6.19dBi | 80 deg | 11.9dB | 20.9dB |
| 787(MHz) | 5.36dBi | 80 deg | 12.1dB | 19.9dB |

FIG. 8C

| Frequency | Maximum gain | 3dB beamwidth | Front-to-back ratio | Co/Cx |
|---|---|---|---|---|
| 746(MHz) | 5.73dBi | 97 deg | 10.1dB | 22.2dB |
| 756(MHz) | 6.21dBi | 98 deg | 10.7dB | 22.2dB |
| 777(MHz) | 6.15dBi | 98 deg | 11.9dB | 20.8dB |
| 787(MHz) | 5.32dBi | 98 deg | 12.1dB | 19.9dB |

FIG. 9C

| Frequency | Maximum gain | 3dB beamwidth | Front-to-back ratio | Co/Cx |
|---|---|---|---|---|
| 746(MHz) | 5.61dBi | 77 deg | 10.5dB | 24.6dB |
| 756(MHz) | 6.19dBi | 77 deg | 10.8dB | 24.2dB |
| 777(MHz) | 6.24dBi | 80 deg | 11.9dB | 23.98dB |
| 787(MHz) | 5.79dBi | 80 deg | 12.0dB | 26.7dB |

FIG. 10C

| Frequency | Maximum gain | 3dB beamwidth | Front-to-back ratio | Co/Cx |
|---|---|---|---|---|
| 746(MHz) | 5.57dBi | 98 deg | 10.5dB | 24.7dB |
| 756(MHz) | 6.14dBi | 98 deg | 10.8dB | 24.2dB |
| 777(MHz) | 6.16dBi | 98 deg | 11.9dB | 23.9dB |
| 787(MHz) | 5.71dBi | 98 deg | 12.0dB | 26.6dB |

FIG. 11C

PLANAR DUAL POLARIZATION ANTENNA

BACKGROUND OF THE INVENTION

1. Field of the Invention

The present invention relates to a planar dual polarization antenna, and more particularly, to a wide-band planar dual polarization antenna capable of effectively reducing antenna dimensions, meeting 45-degree slant polarization requirements, generating linearly polarized electromagnetic waves, and providing two symmetric feed-in points to generate an orthogonal dual-polarized antenna field pattern.

2. Description of the Prior Art

Electronic products with wireless communication functionalities, e.g. notebook computers, personal digital assistants, etc., utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas. For example, a long term evolution (LTE) wireless communication system and a wireless local area network standard IEEE 802.11n both support multi-input multi-output (MIMO) technology, i.e. an electronic product is capable of concurrently receiving and transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality. Moreover, MIMO communication systems can employ techniques such as spatial multiplexing, beam forming, spatial diversity, pre-coding, etc. to further reduce signal interference and increase channel capacity.

As can be seen from the above, a prerequisite for implementing spatial multiplexing and spatial diversity in MIMO is to employ multiple sets of antenna to divide a space into many channels, in order to provide multiple antenna field patterns. Therefore, it is a common goal in the industry to design antennas that suit both transmission demands, as well as dimension and functionality requirements.

SUMMARY OF THE INVENTION

Therefore, the present invention primarily provides a planar dual polarization antenna.

The present invention discloses a planar dual polarization antenna, for receiving and transmitting radio signals, including a ground metal plate; a first dielectric board, formed on the ground metal plate; and a first patch plate, formed on the first dielectric board, the first patch plate having a shape substantially conforming to a cross pattern.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 8C is a schematic diagram of field pattern simulation results of the planar dual polarization antenna of the present invention for 45-degree slant polarization on the vertical plane.

FIG. 9C is a schematic diagram of field pattern simulation results of the planar dual polarization antenna of the present invention for 45-degree slant polarization on the horizontal plane.

FIG. 10C is a schematic diagram of field pattern simulation results of the planar dual polarization antenna of the present invention for 135-degree slant polarization on the vertical plane.

FIG. 11C is a schematic diagram of field pattern simulation results of the planar dual polarization antenna of the present invention for 135-degree slant polarization on the horizontal plane.

DETAILED DESCRIPTION

For a dual-input dual-output LTE wireless communication system, wireless signals are received and transmitted via two antenna wave beams, and the antennas are 45-degree slant polarized. Therefore, after two orthogonal dual polarization antennas are slanted by 45 degrees, one antenna becomes 45-degree slant polarized and the other becomes 135-degree slant polarized. Such antennas must have minimum physical dimensions while satisfying system electrical characteristics. In such a case, it is possible to use a planar microstrip antenna structure as a basis and design a 45-degree slant polarized multi-layer planar dual polarization microstrip antenna.

Figure 1A:
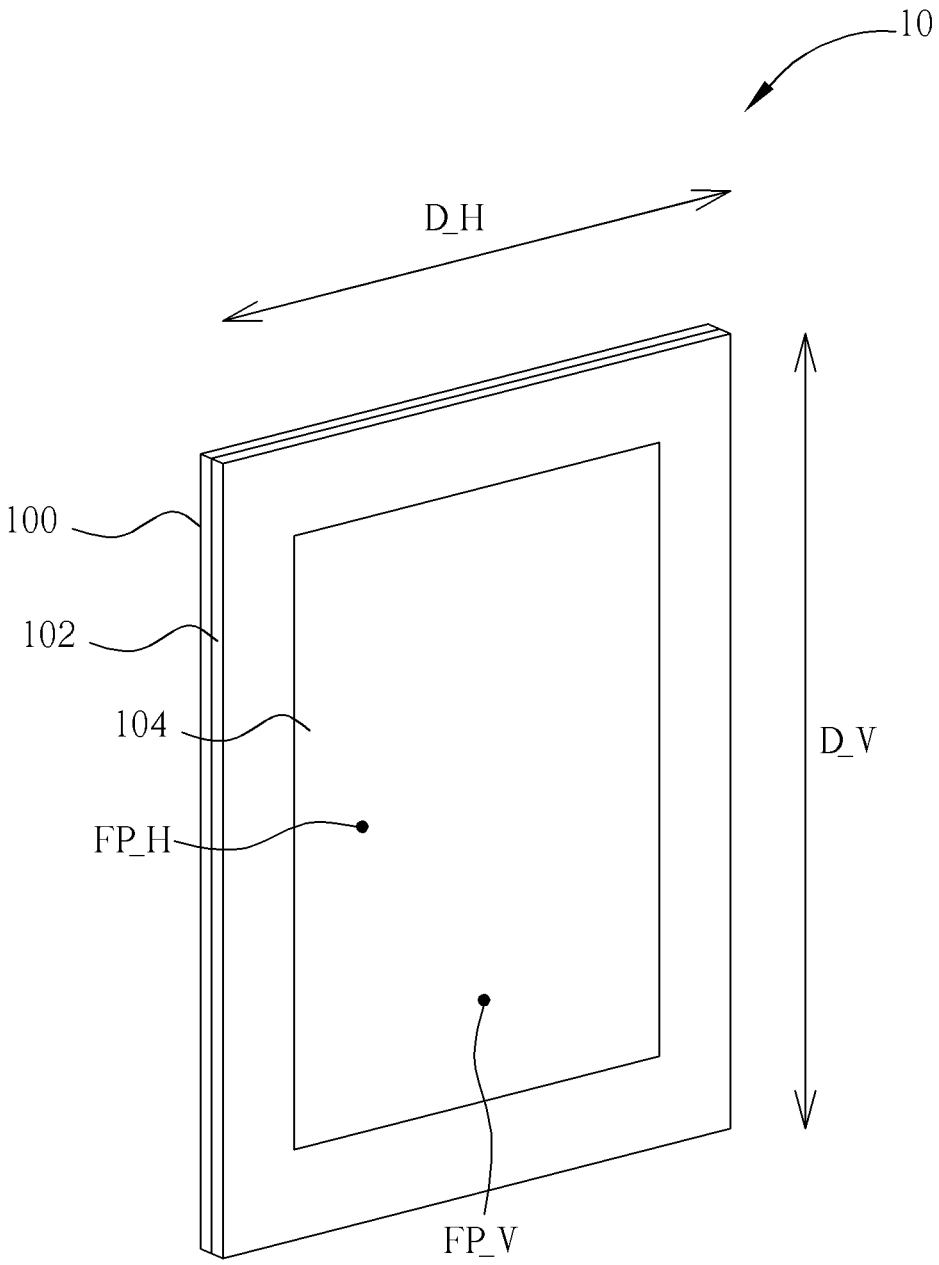
FIG. 1A PRIOR ART
FIGS. 1A, 1B and 1C are schematic diagrams of a dual-polarized microstrip antenna.
Figure 1B:
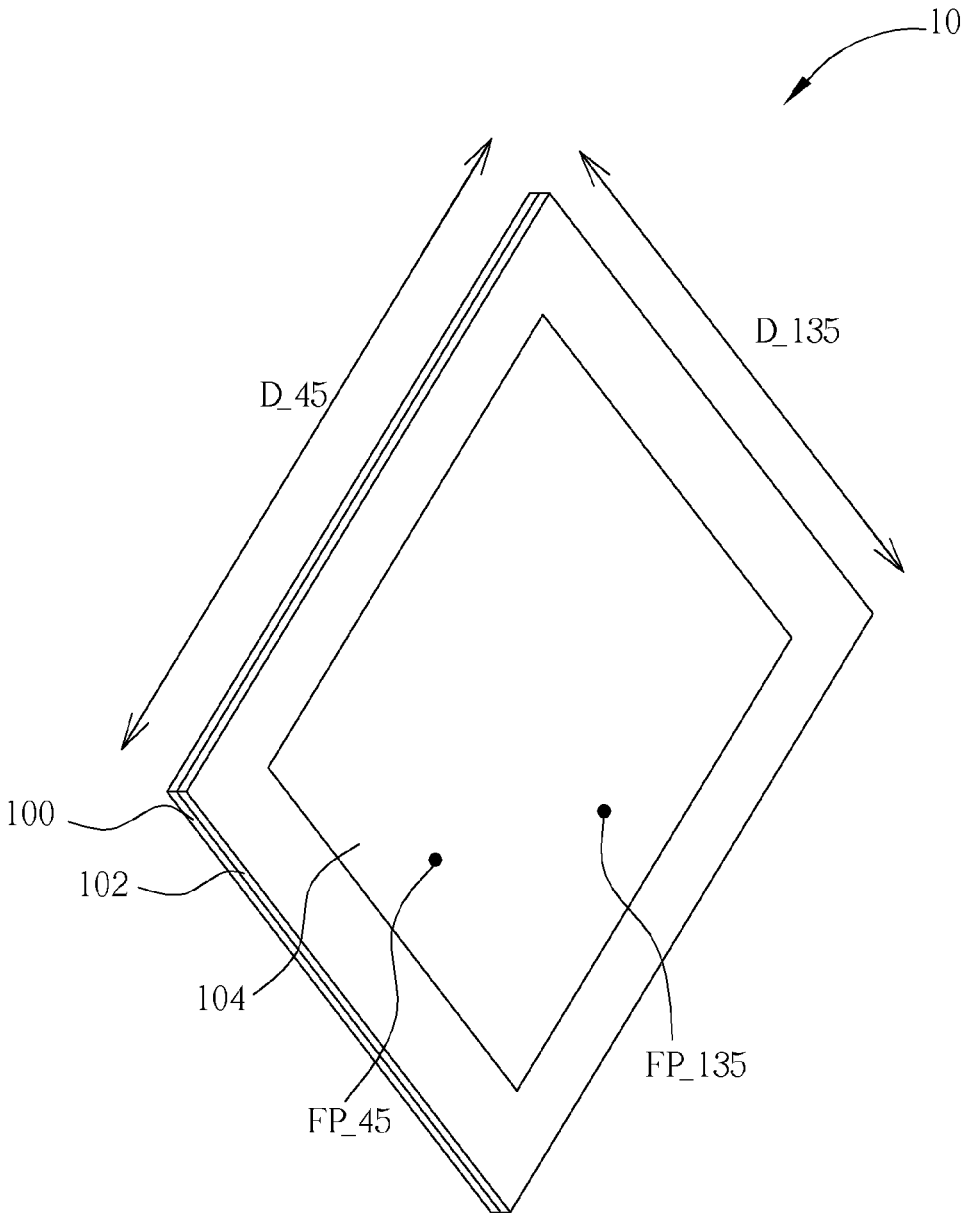
FIG. 1B PRIOR ART

Please refer to FIG. 1A, which is a schematic diagram of a dual-polarized microstrip antenna 10. The dual-polarized microstrip antenna 10 includes a ground metal plate 100, a dielectric board 102 and a patch plate 104, and is a three-layered square architecture. The ground metal plate 100 is used for providing a ground, the patch plate 104 is the main radiating body, and the dielectric board 102 is disposed between the ground metal plate 100 and the patch plate 104. Since the patch plate 104 is square-shaped, a direction of vertical polarization is along a vertical edge D_V, and a direction of horizontal polarization is along a horizontal edge D_H. Feed-in points for the vertical polarization and the horizontal polarization are FP_V and FP_H, respectively. In such a case, the simplest method for making the dual-polarized microstrip antenna 10 to be 45-degree slant and 135-degree slant polarized is to rotate the antenna 10 by 45 degrees, as shown in FIG. 1B. Concurrently, the horizontal and vertical polarizations would become 45-degree and 135-degree slant, respectively, and the antenna 10 changes from a square shape to a rhombus shape, and resonance of the antenna is still along the directions of the edges, i.e. D_45 and D_135, and the feed-in points of the vertical and horizontal polarizations are still at the same relative positions, i.e. FP_45 and FP_135.

Figure 1C:
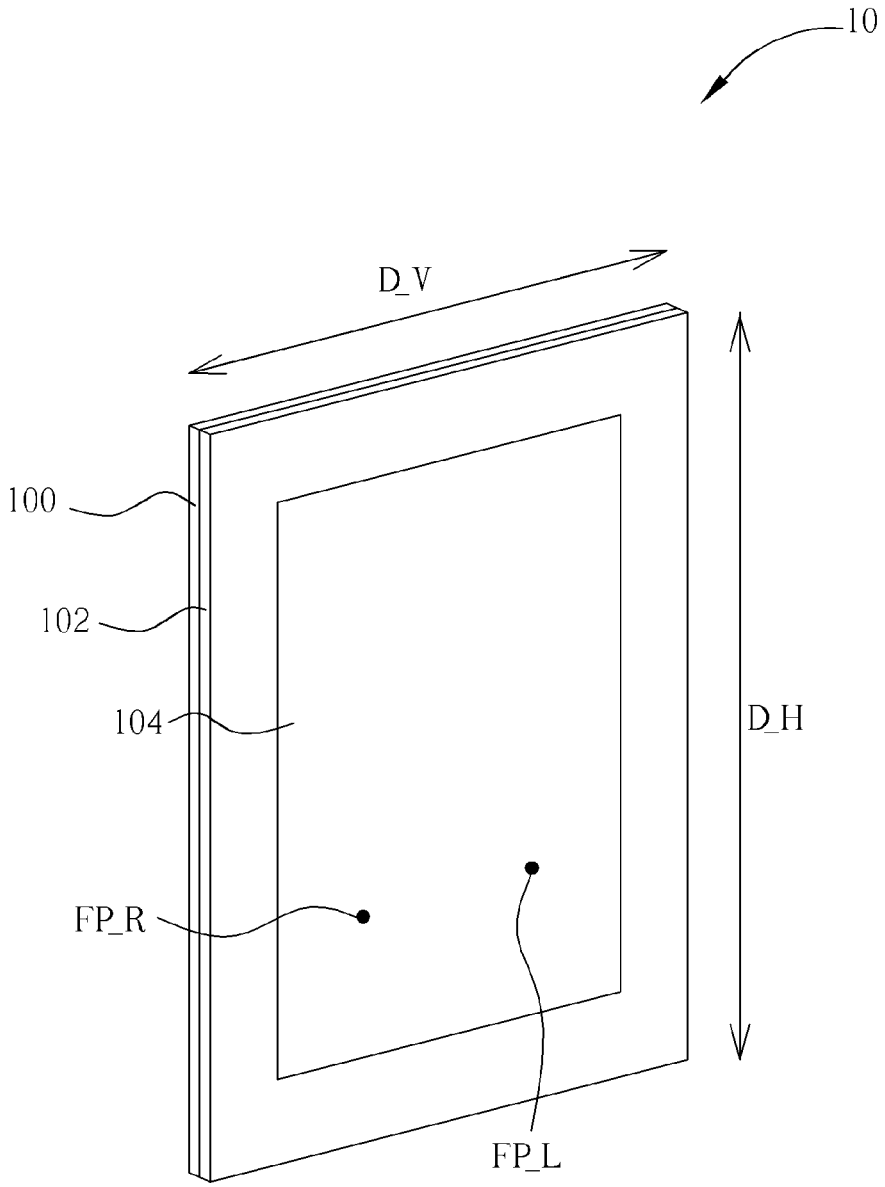
FIG. 1C PRIOR ART

It is possible to reduce dimensions of the antenna if the resonance directions of the dual-polarized microstrip antenna 10 are changed to diagonals of the square shape, wherein the dimensions of the dual-polarized microstrip antenna 10 would be reduced to 0.7 times of original dimensions. To further fulfill requirements for the 45-degree slant polarization, in theory, it is only needed to rotate positions of the feed-in points of the dual-polarized microstrip antenna 10 by 45 degrees, i.e. FP_R and FP_L in FIG. 1C. However, the antenna becomes circularly polarized after the feed-in points are rotated by 45 degrees. One becomes a right-hand circularly polarized antenna and the other becomes a left-hand circularly polarized antenna, and resonance directions are still along the directions of the edges, i.e. D_V, D_H, and the antenna does not decrease in dimensions. In other words, results yielded by rotating the feed-in points by 45-degree do not match requirements, and the antenna dimensions are not reduced.

Figure 2A:
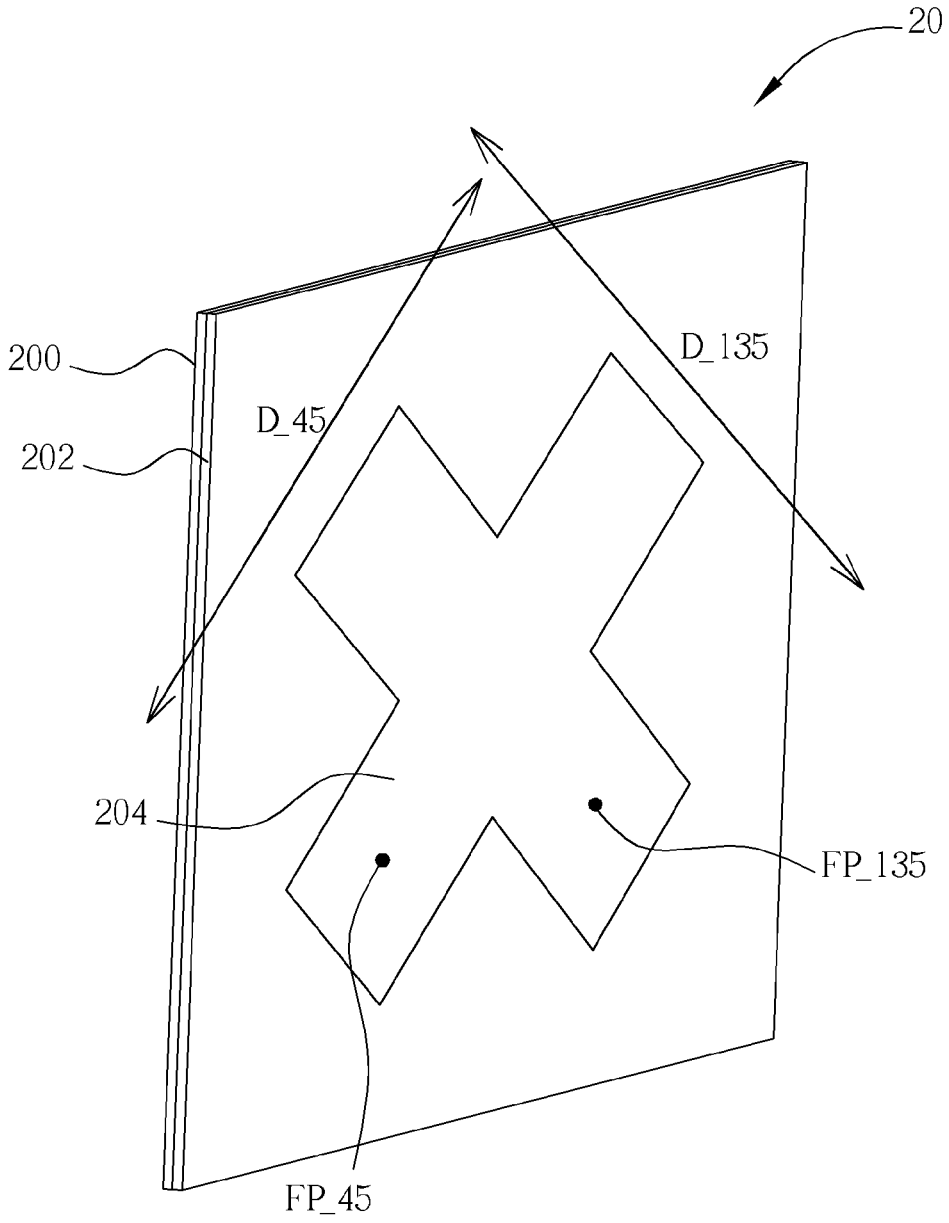
FIG. 2A is a schematic diagram of a planar dual polarization antenna according to an embodiment of the present invention.

To solve the above-mentioned problem, the present invention further provides a planar dual polarization antenna 20, as shown in FIG. 2A. The planar dual polarization antenna 20 includes a ground metal plate 200, a dielectric board 202 and a patch plate 204. The planar dual polarization antenna 20 and the dual-polarized microstrip antenna 10 have similar architectures, and are both three-layered structures. The ground metal plate 200 is used for providing the ground, the patch plate 204 is the main radiating body, and the dielectric board 202 is disposed between the ground metal plate 200 and the patch plate 204. A difference is that the patch plate 204 has a shape substantially conforming to a cross pattern to generate electromagnetic waves with linear polarization and not circular polarization, and concurrently to effectively reduce the dimensions of the antenna.

In more detail, in the planar dual polarization antenna 20, the ground metal plate 200 and the dielectric board 202 are maintained to be square shapes, but the patch plate 204 is cross-shaped. This makes the resonance directions to be along the diagonals, i.e. as shown by D_45 and D_135. Also, the dimensions of the antenna are reduced to 0.7 times of the original (i.e. the dual-polarized microstrip antenna 10 in FIG. 1A). Furthermore, the cross-shaped patch plate 204 can provide two symmetric feed-in points and generate an orthogonal dual-polarized antenna pattern, as shown in FIG. 2A.

In short, the present invention utilizes the patch plate 204, which is substantially a cross shape, to change the resonance direction to be along the diagonals of the square shape. This reduces the antenna to 0.7 times of the original dimensions while meeting 45-degree slant polarization requirements, generates linear polarized electromagnetic waves, and provides two symmetric feed-in points to generate an orthogonal dual-polarized antenna pattern.

Figure 2B:
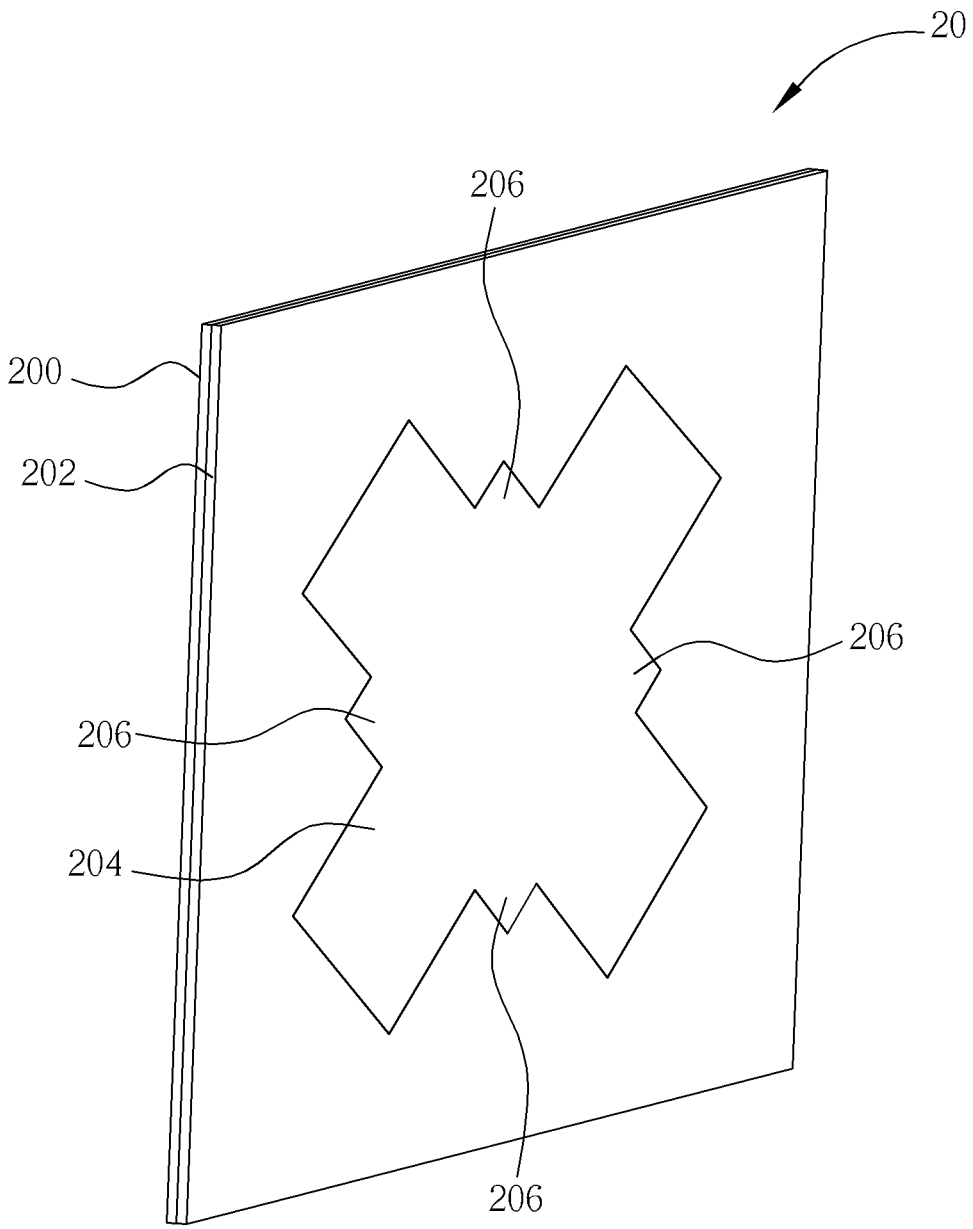
FIGS. 2B to 2F and FIGS. 3A to 3H are schematic diagrams of different embodiments of the planar dual polarization antenna shown in FIG. 2A.
Figure 2C:
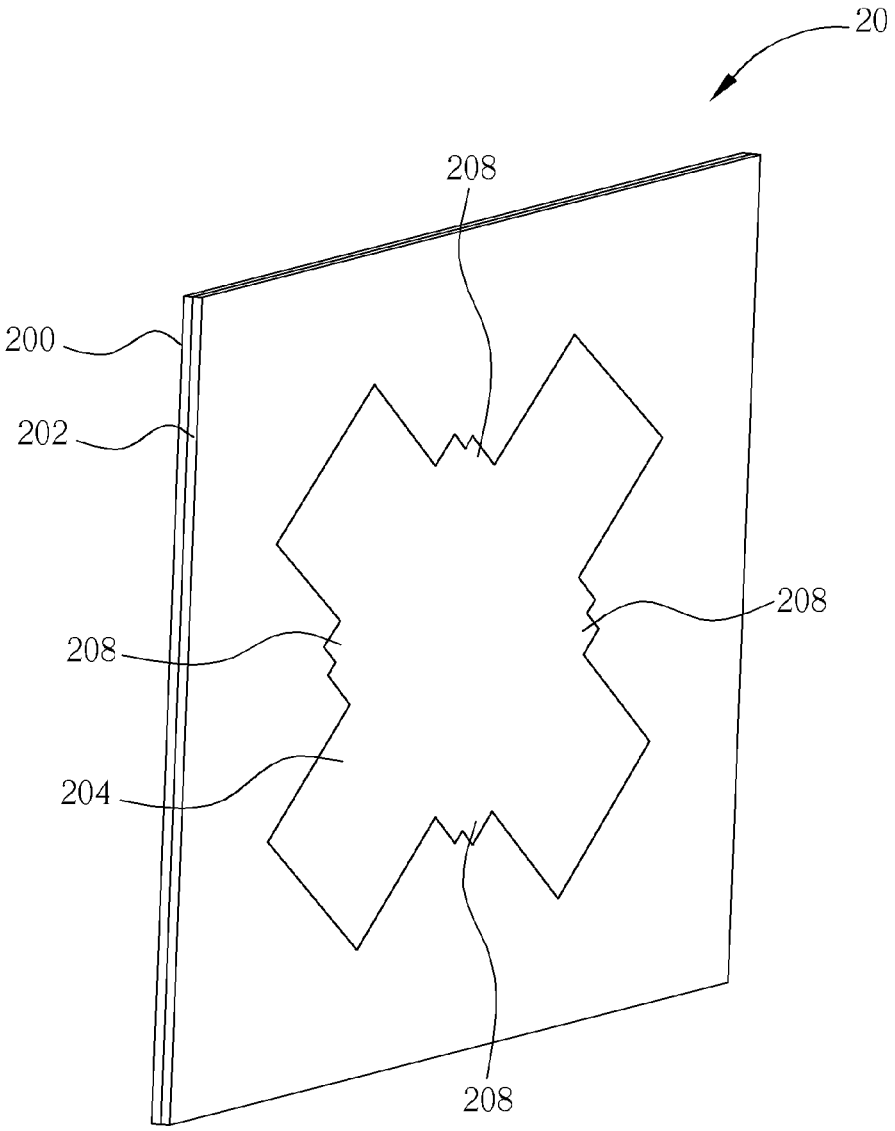
Figure 2D:
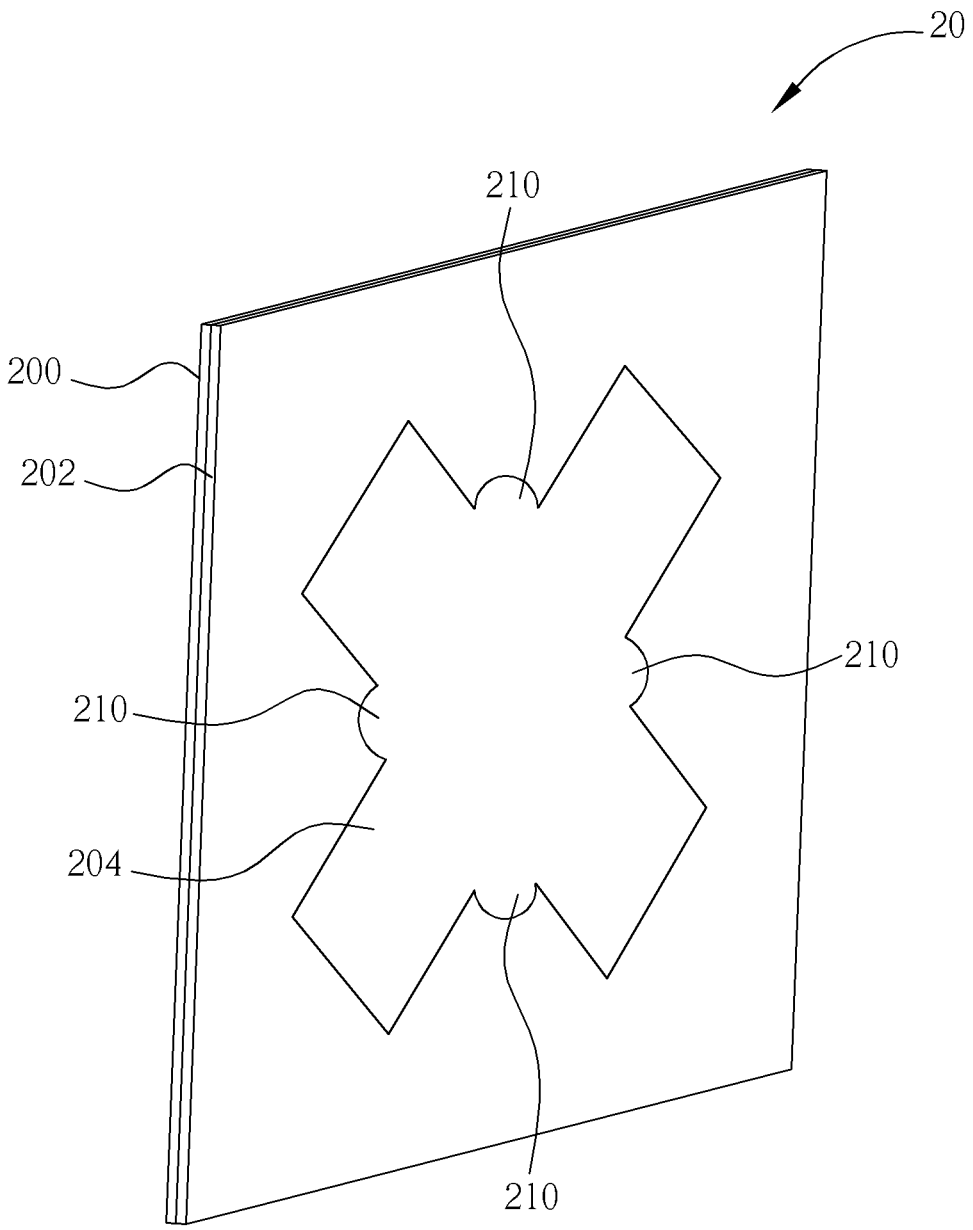
Figure 2E:
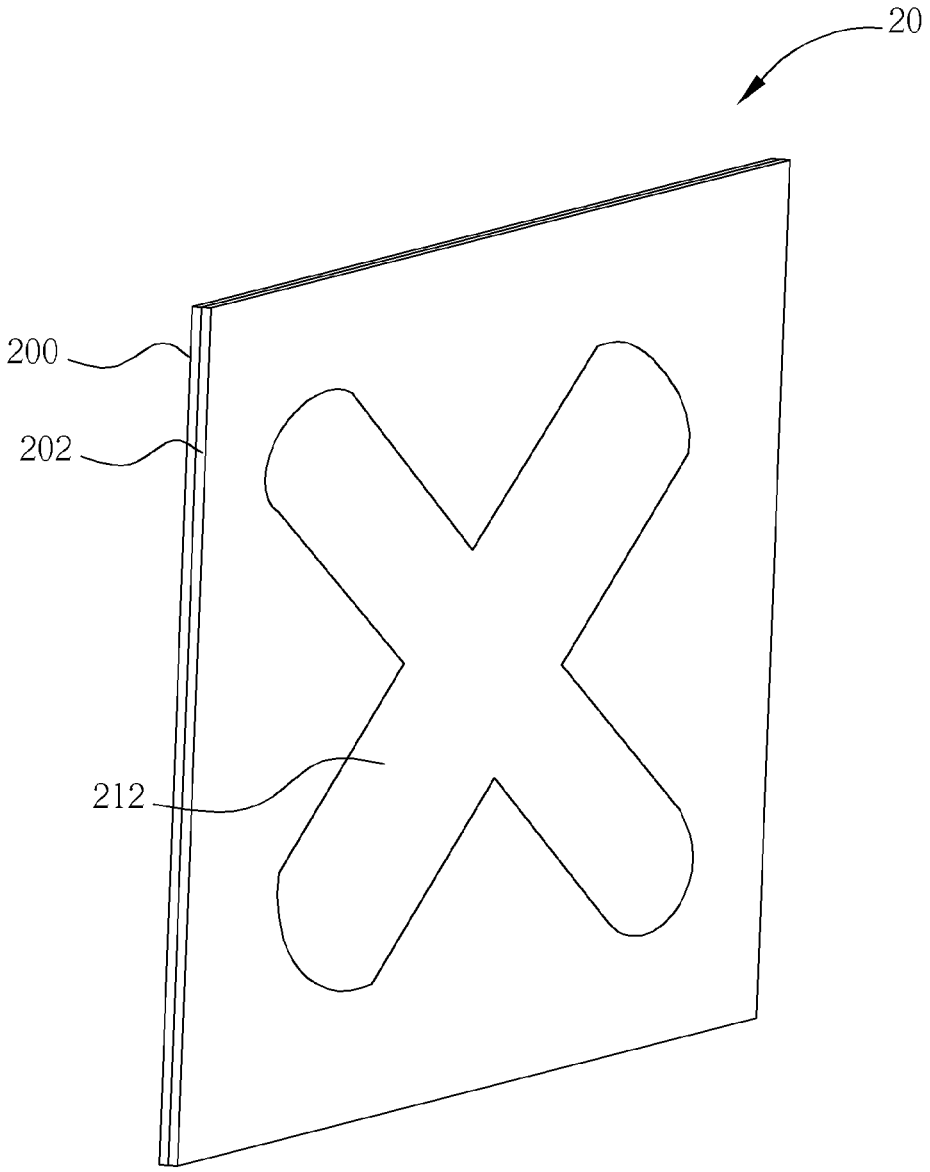
Figure 2F:
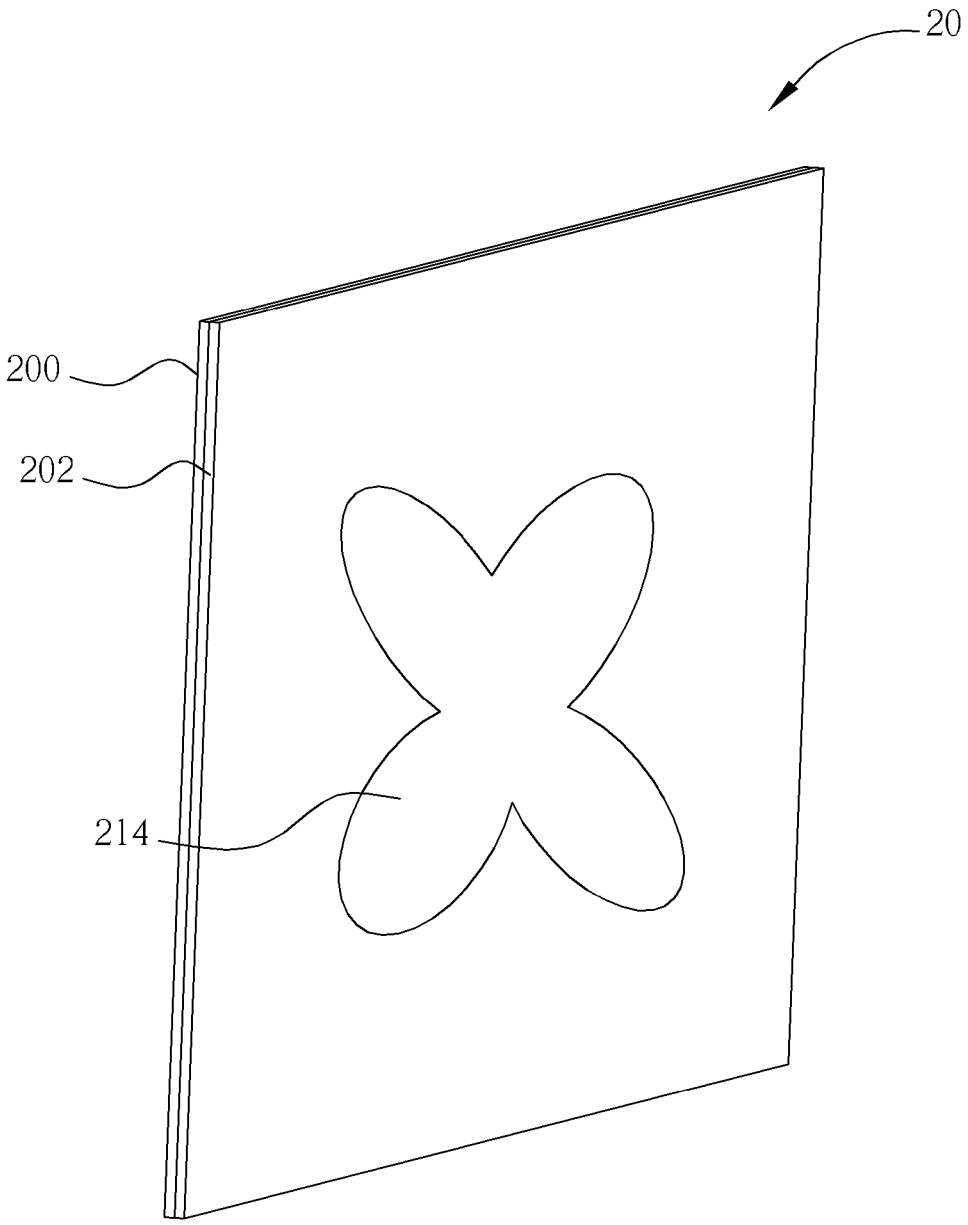

Note that, in the present invention, having a shape "substantially conforming to a cross pattern" relates to the patch plate 204 being formed by two overlapping and intercrossing rectangular patch plates. However, this is not limited thereto, and any patch plate having a shape "substantially conforming to a cross pattern" are within the scope of the present invention. For example, the patch plate 204 extends outside a square side plate 206, as shown in FIG. 2B; the patch plate 204 extends outside a saw-tooth shaped side plate 208, as shown in FIG. 2C; the patch plate 204 further extends outside the arc-shaped side plate 210, as shown in FIG. 2D; the patch plate 204 is replaced by a patch plate 212 with rounded edges, as shown in FIG. 2E; and the patch plate 204 is replaced by a leaf-shaped patch plate 214, as shown in FIG. 2F. FIGS. 2B to 2F all have shapes that "substantially conform to a cross pattern" according to the present invention, but this is not limited thereto, and those skilled in the art may make alterations accordingly.

Figure 3A:
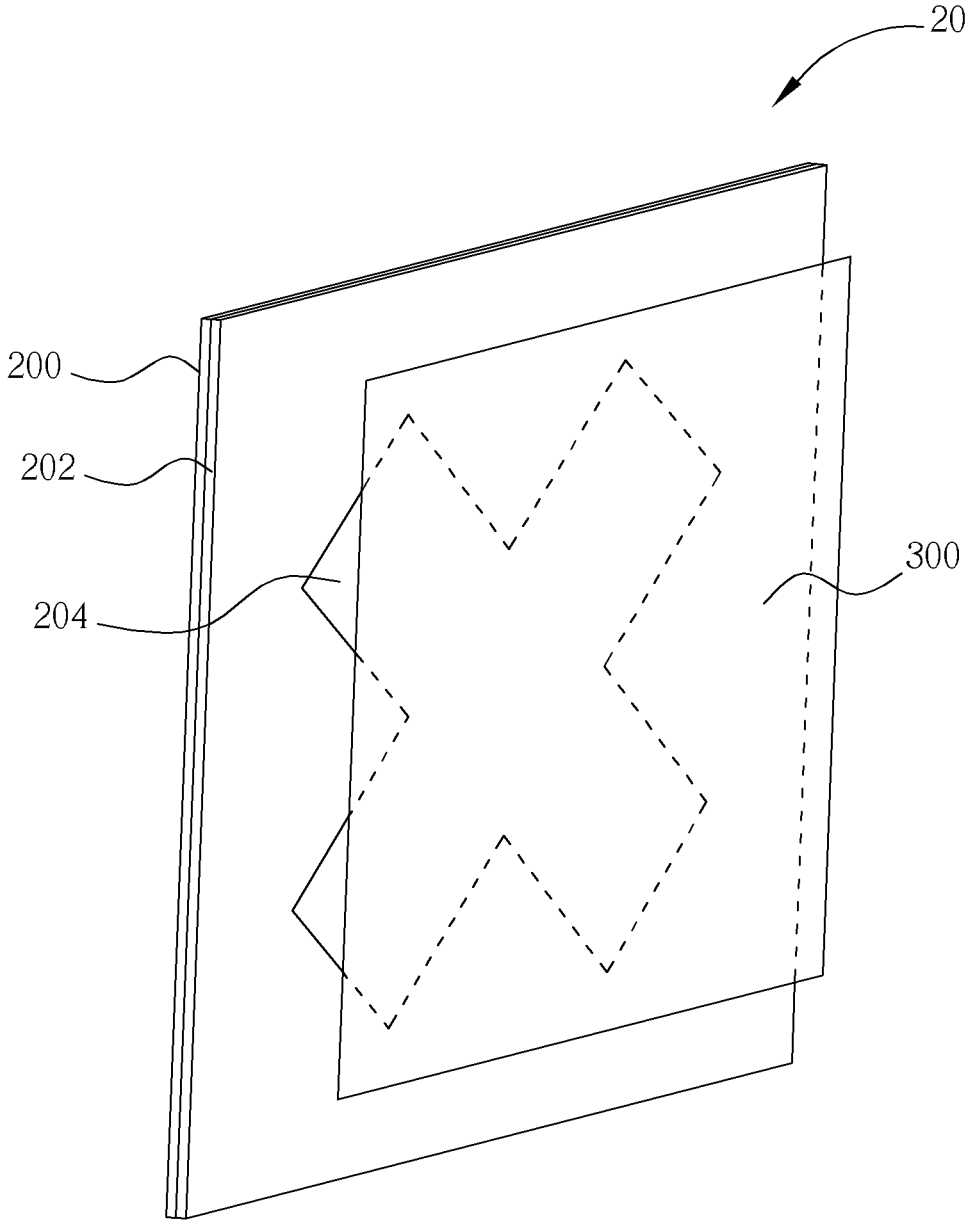
Figure 3B:
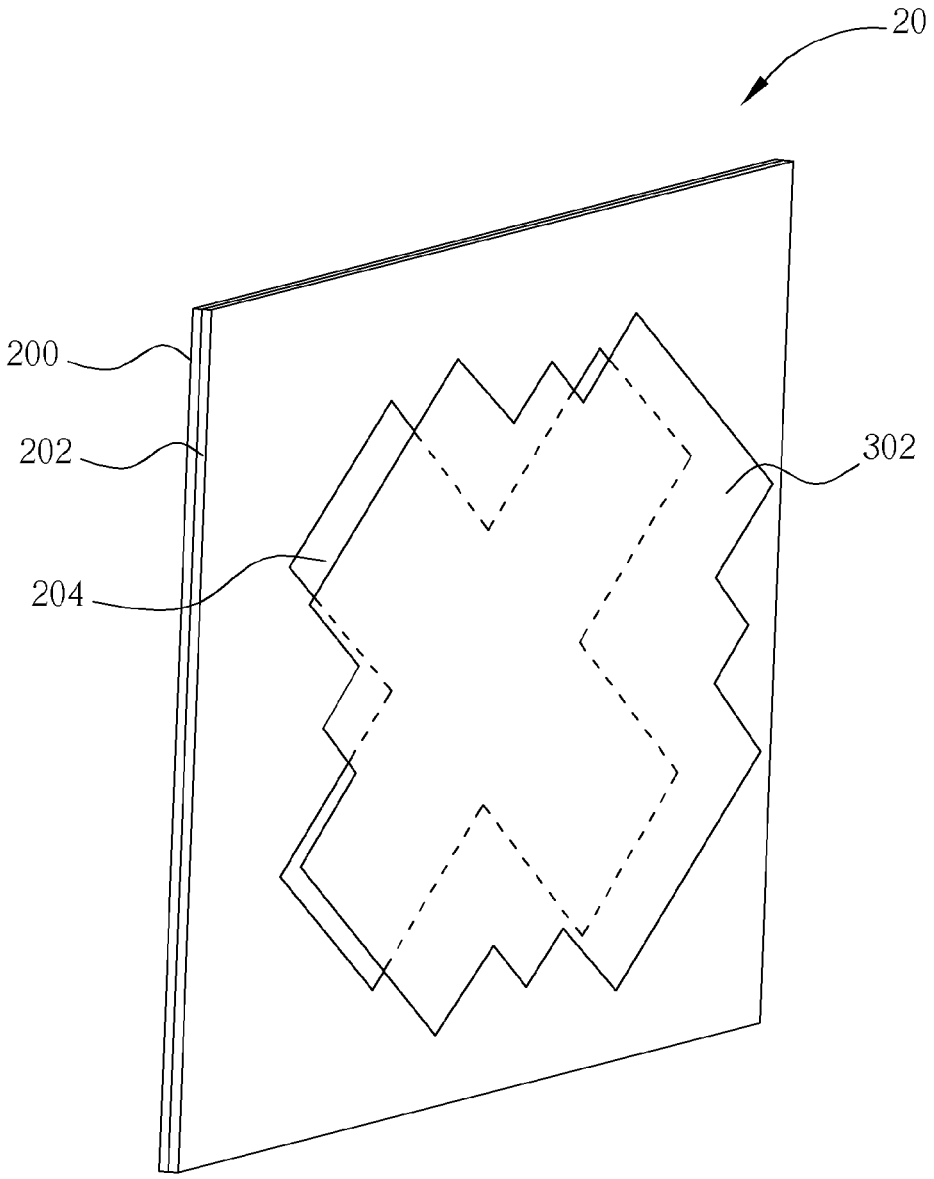
Figure 3C:
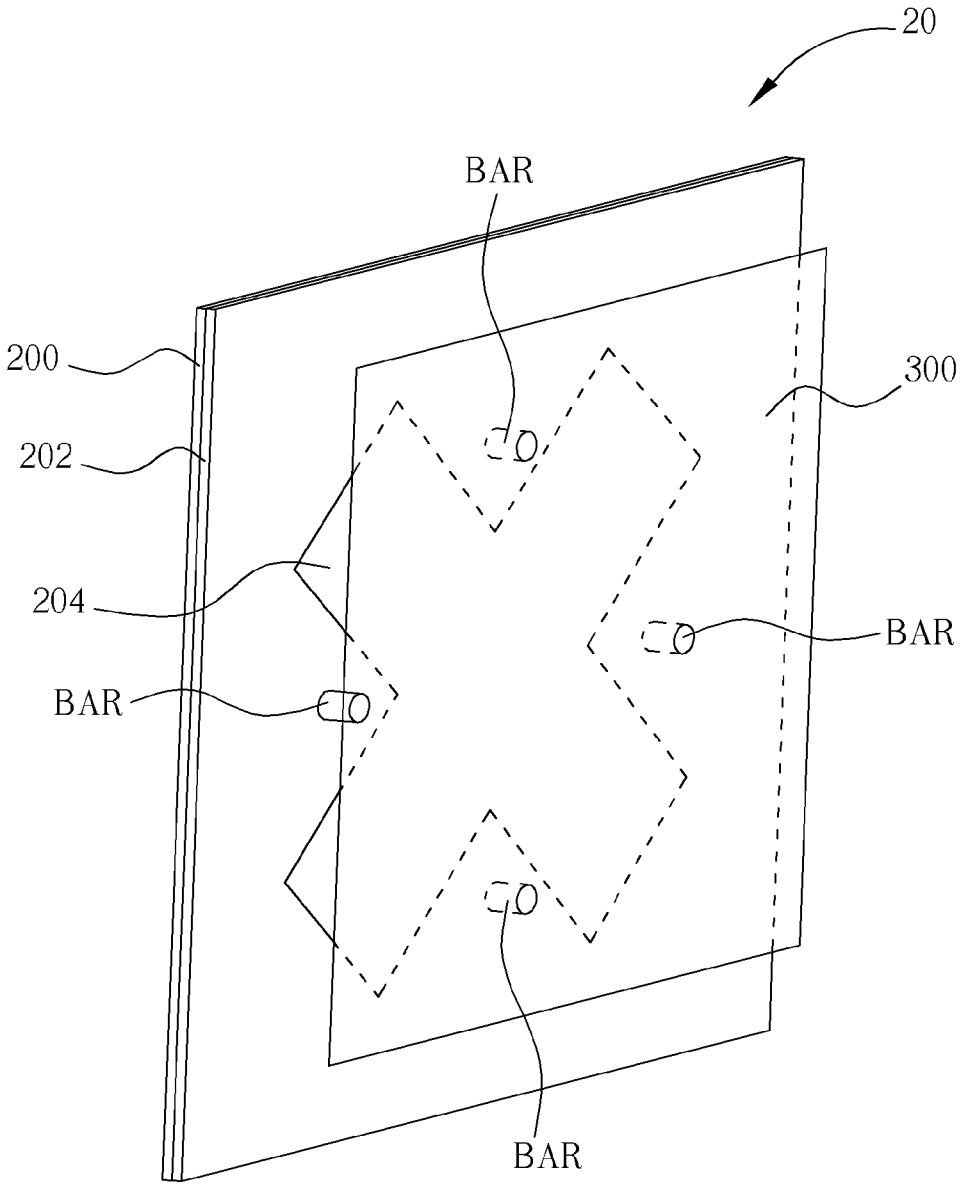
Figure 3D:
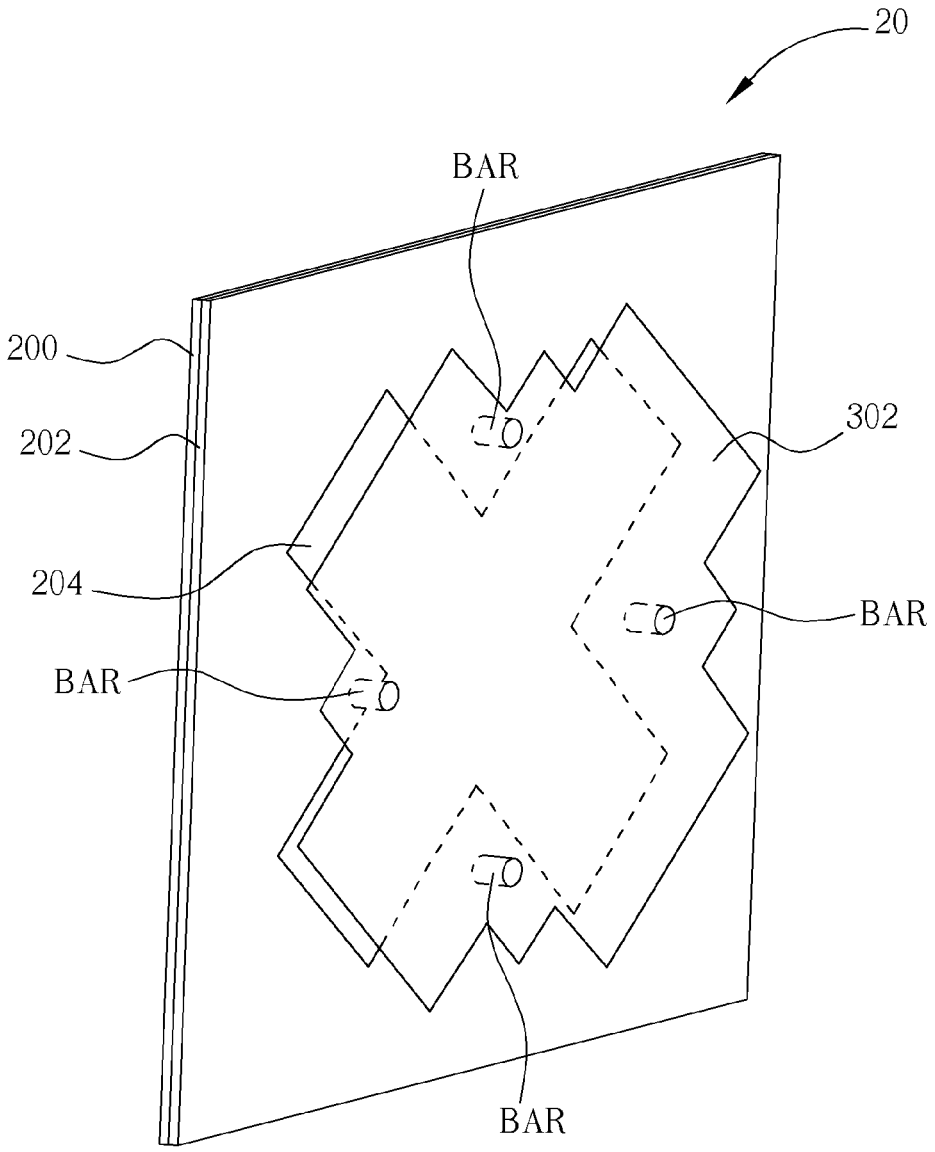
Figure 3E:
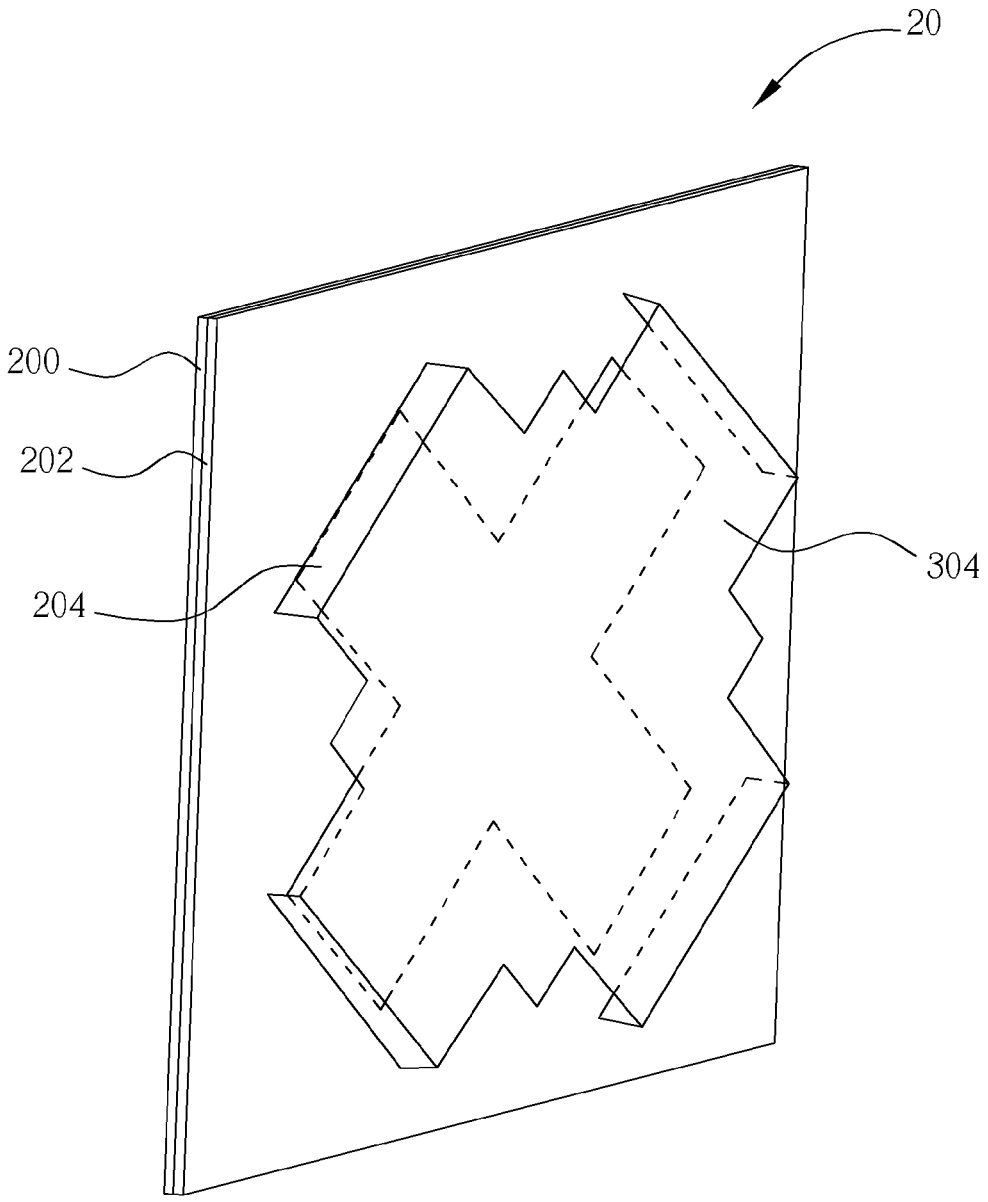
Figure 3F:
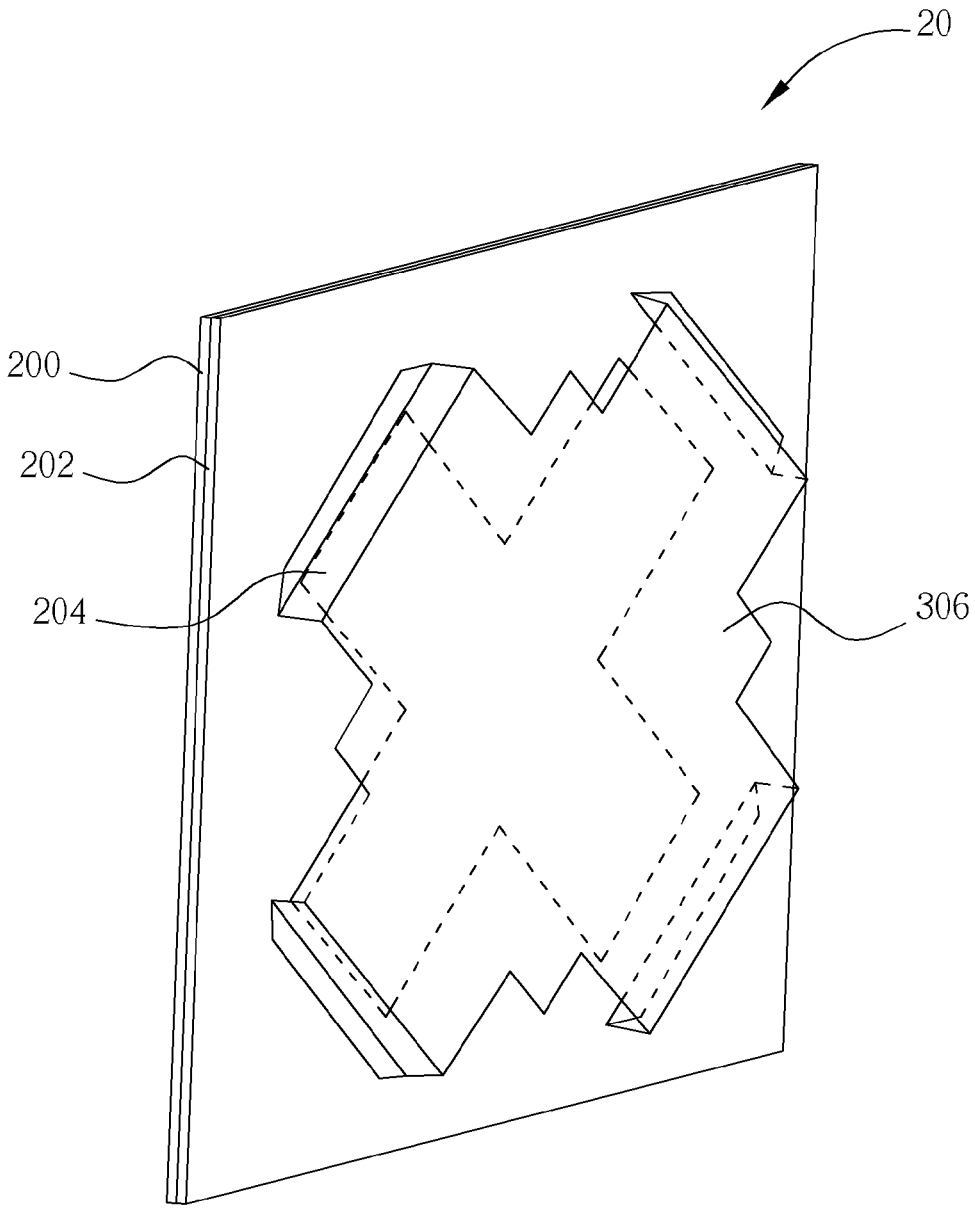

On the other hand, the planar dual polarization antenna 20 has a resonance bandwidth relative to approx. 3% of the resonance frequency. For LTE wireless communication system applications, the antenna has a resonance frequency centered at 766.5 MHz, and a bandwidth of 41 MHz, equivalent to a resonance bandwidth relative to approx. 5.3% of the resonance frequency. Therefore, as shown in FIG. 3A, the present invention may further add a patch plate 300 on the patch plate 204 of the planar dual polarization antenna 20 to increase resonance bandwidth of the antenna. The patch plate 300 and the patch plate 204 are not in contact, and may have shapes not limited to the square shape shown in FIG. 3A, e.g. shapes substantially conforming to a cross pattern, as the patch plate 204. For example, in FIG. 3B, the patch plate 300 is substituted by a patch plate 302 with a shape that is substantially a cross pattern. Additionally, the patch plate 204 is the main radiating body, and thus it is not in contact with the added patch plate 300 or 302. There are many ways to ensure the patch plate 300 or 302 do not contact the patch plate 204. For example, in FIGS. 3C and 3D, a supporting element formed by four cylinders BAR fixates the patch plate 300 or 302, such that the patch plate 300 or 302 is not in contact with the patch plate 204. Alternatively, as shown in FIGS. 3E and 3F, patch plates 304 and 306 are formed by incorporating bends into the four edges of the patch plate 302, such that the patch plates 304 and 306 are only in contact with the dielectric board 202, but not with the patch plate 204. Additionally, as shown in FIGS. 3G and 3H, it is possible to further utilize a dielectric layer 308 or 310 to keep the patch plate 306 (or 300, 302, 304, etc.) from contacting the patch plate 204.

Figure 4:
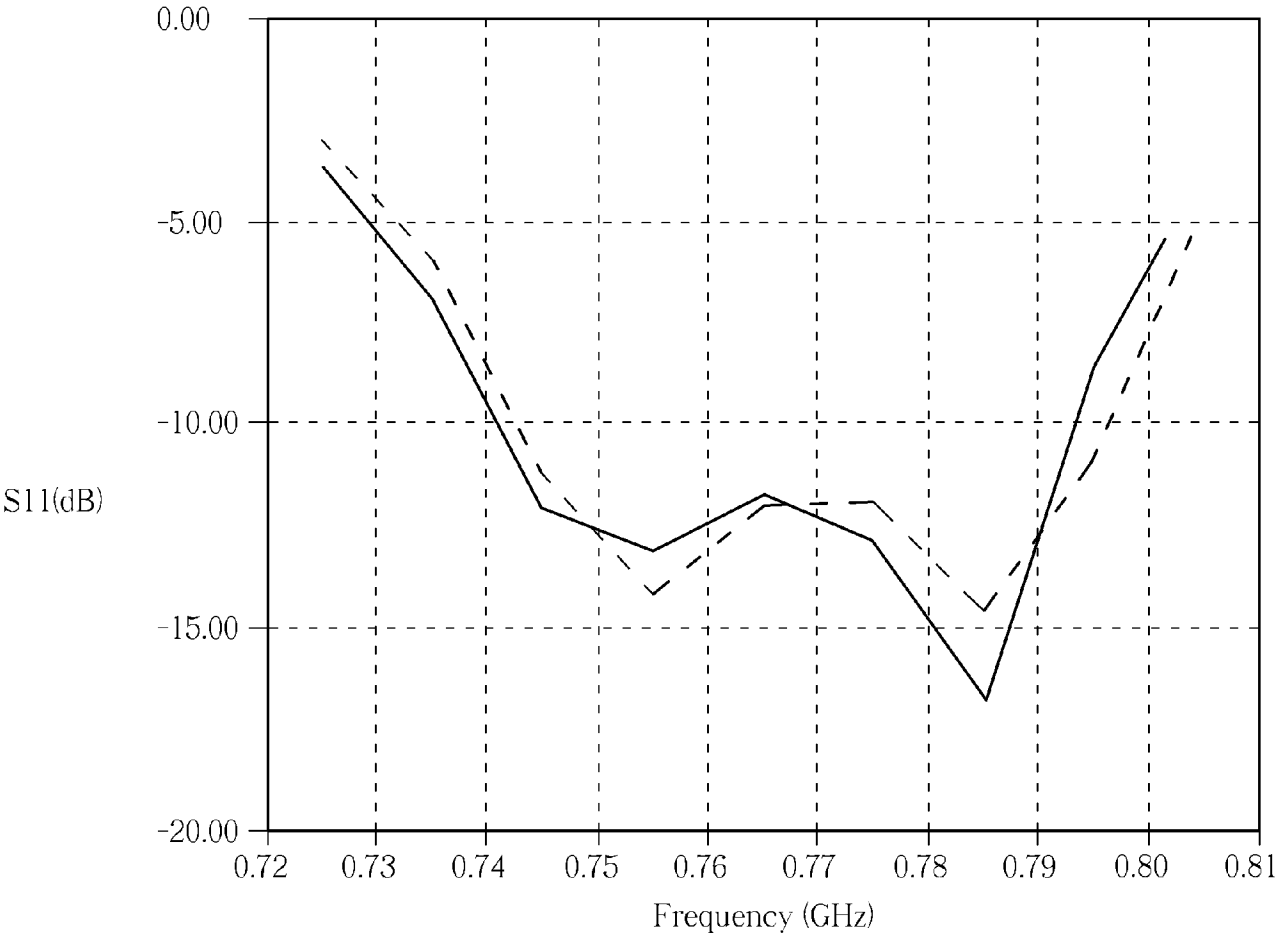
FIG. 4 is a schematic diagram of antenna resonance simulation results for the planar dual polarization antenna of the present invention applied to an LTE wireless communication system.
Figure 5:
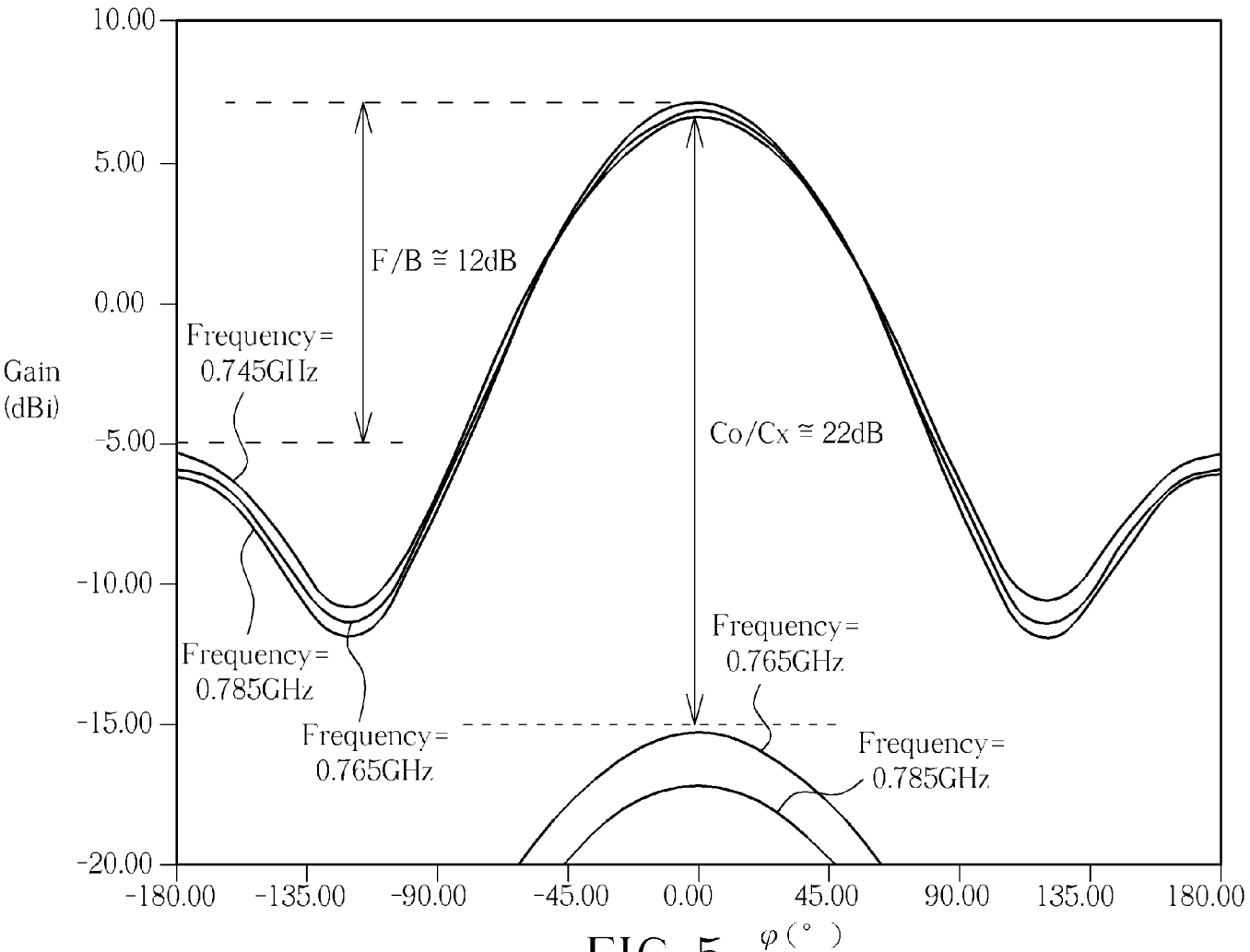
FIG. 5 is a schematic diagram of antenna pattern characteristic simulation results of the planar dual polarization antenna of the present invention applied to the LTE wireless communication system.

Note that, FIGS. 3A to 3H illustrate feasible variations of the present invention, and other variations in accordance with the concept of the present invention and the system requirements may all be applied to the present invention, and are not limited thereto. Simulation and measurement may be employed to determine whether system requirements are met. For example, FIG. 4 is a schematic diagram of antenna resonance simulation results (voltage standing wave ratio) for the planar dual polarization antenna 20 shown in FIG. 3G, applied to an LTE wireless communication system. In FIG. 4, simulation results for antenna resonance with 45-degree slant polarization and 135-degree slant polarization are represented by dotted and solid lines, respectively. It can be seen that S11 has values below −10 dB from 746 MHz to 787 MHz, which is a considerably wide resonance bandwidth. Isolation between 45-degree and 135-degree slant polarization is at least 20 dB or above. Furthermore, FIG. 5 is a schematic diagram of antenna pattern characteristic simulation results of the planar dual polarization antenna 20 shown in FIG. 3G, applied to the LTE wireless communication system. As can be seen from FIG. 5, a maximum gain value is approx. 6.6 dBi, a front-to-back ratio is at least 12 dB, and a common polarization to cross polarization ratio Co/Cx is at least 22 dB. Therefore, FIGS. 4 and 5 show that the planar dual polarization antenna 20 of the present invention meets LTE wireless communication system requirements.

Figure 3G:
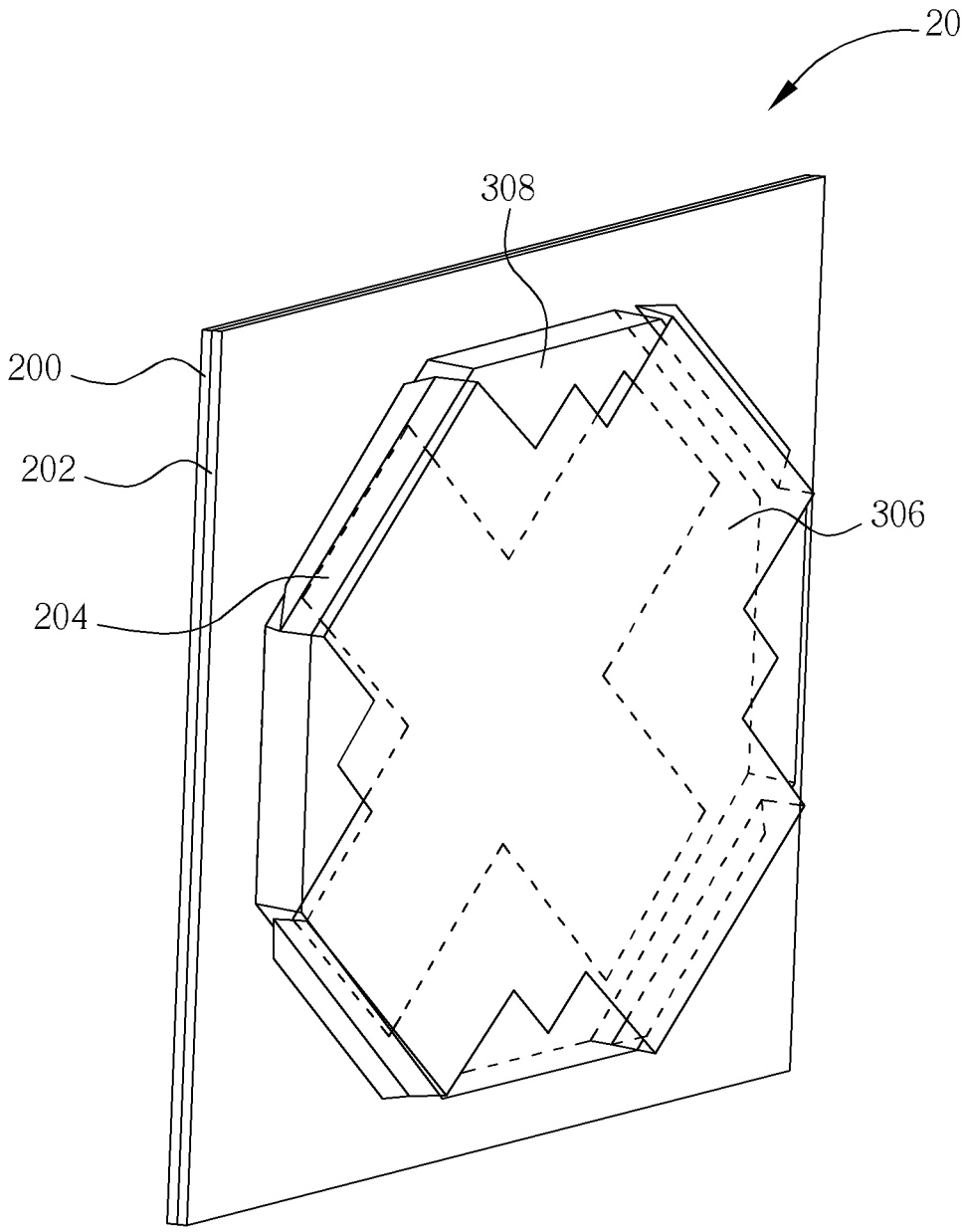
Figure 3H:
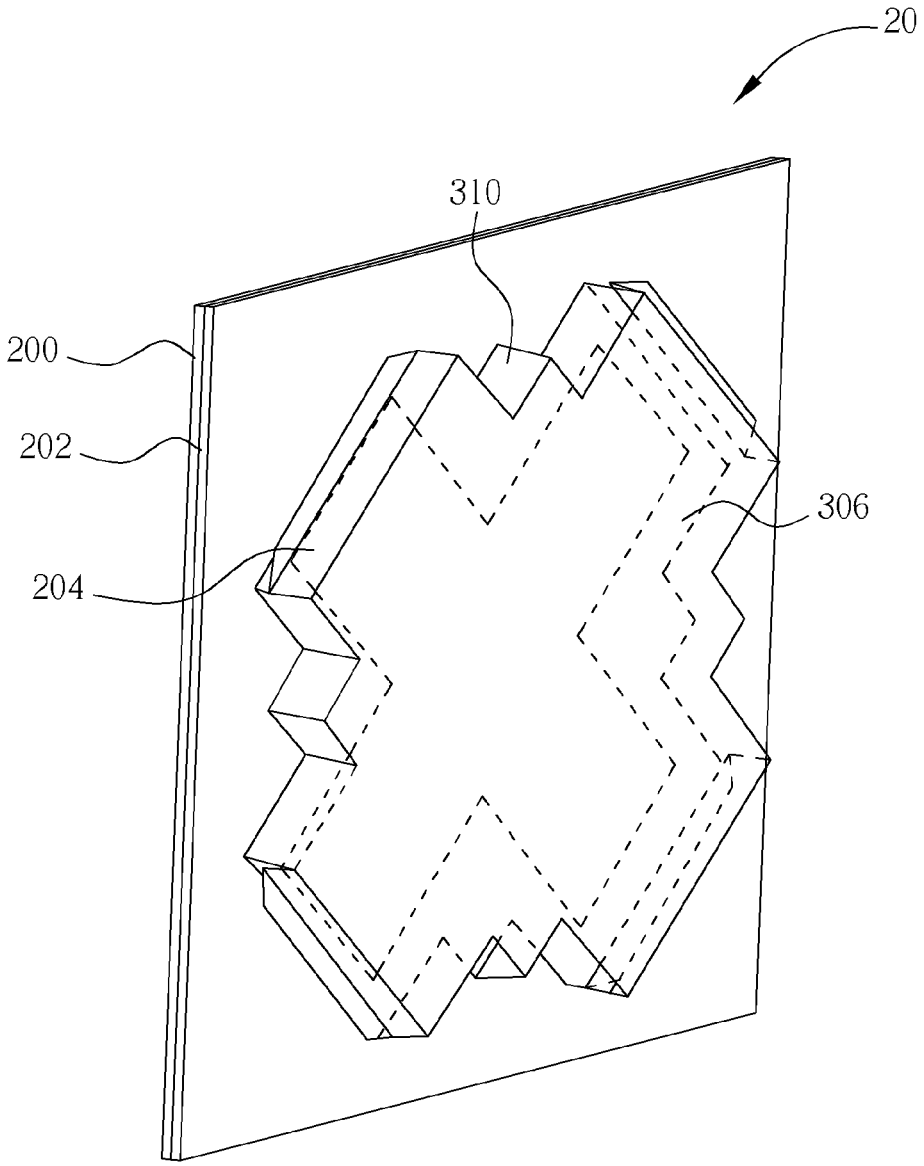
Figure 6A:
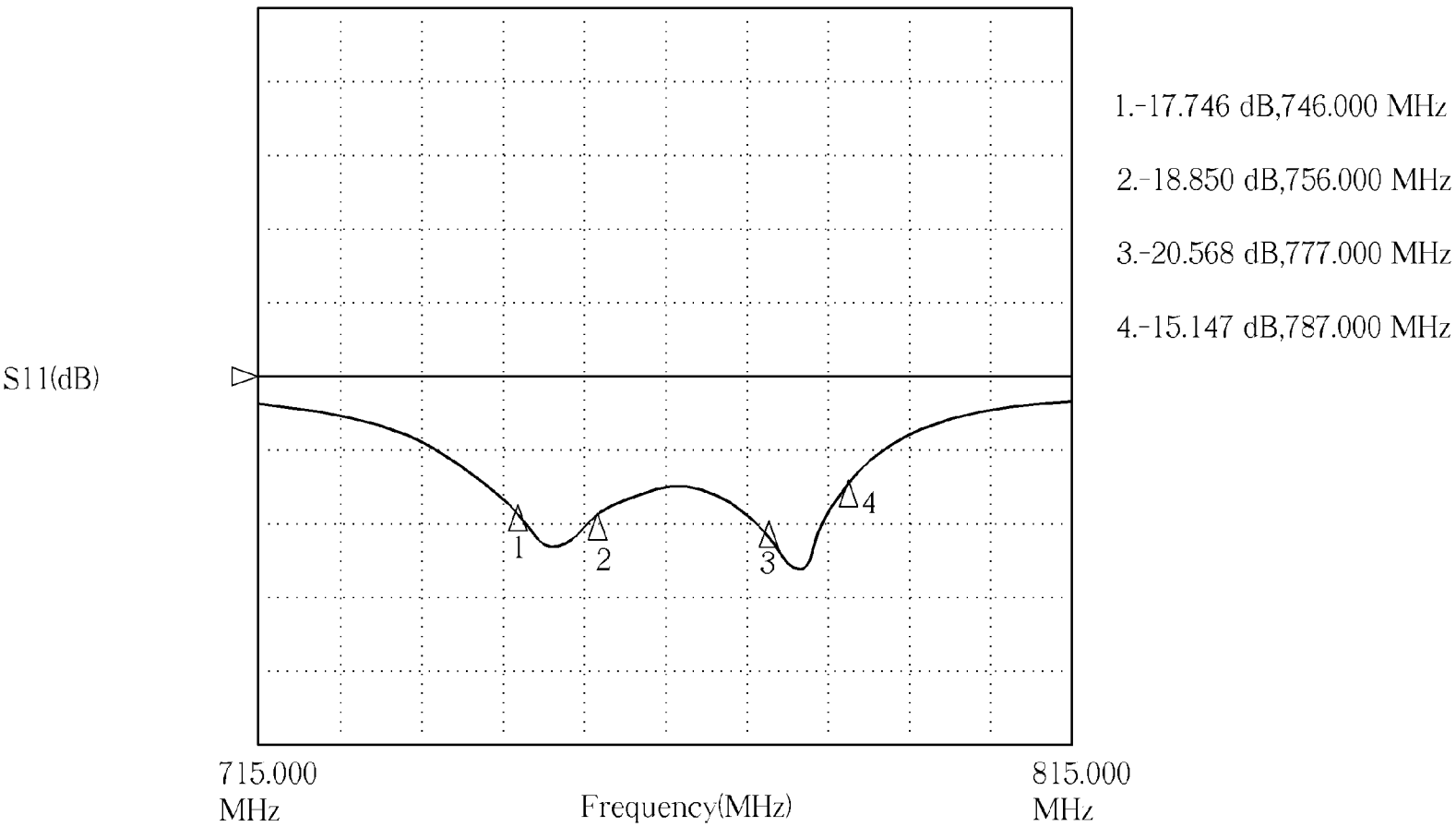
FIG. 6A is a schematic diagram of antenna resonance simulation results of the planar dual polarization antenna of the present invention for 45-degree slant polarization.
Figure 6B:
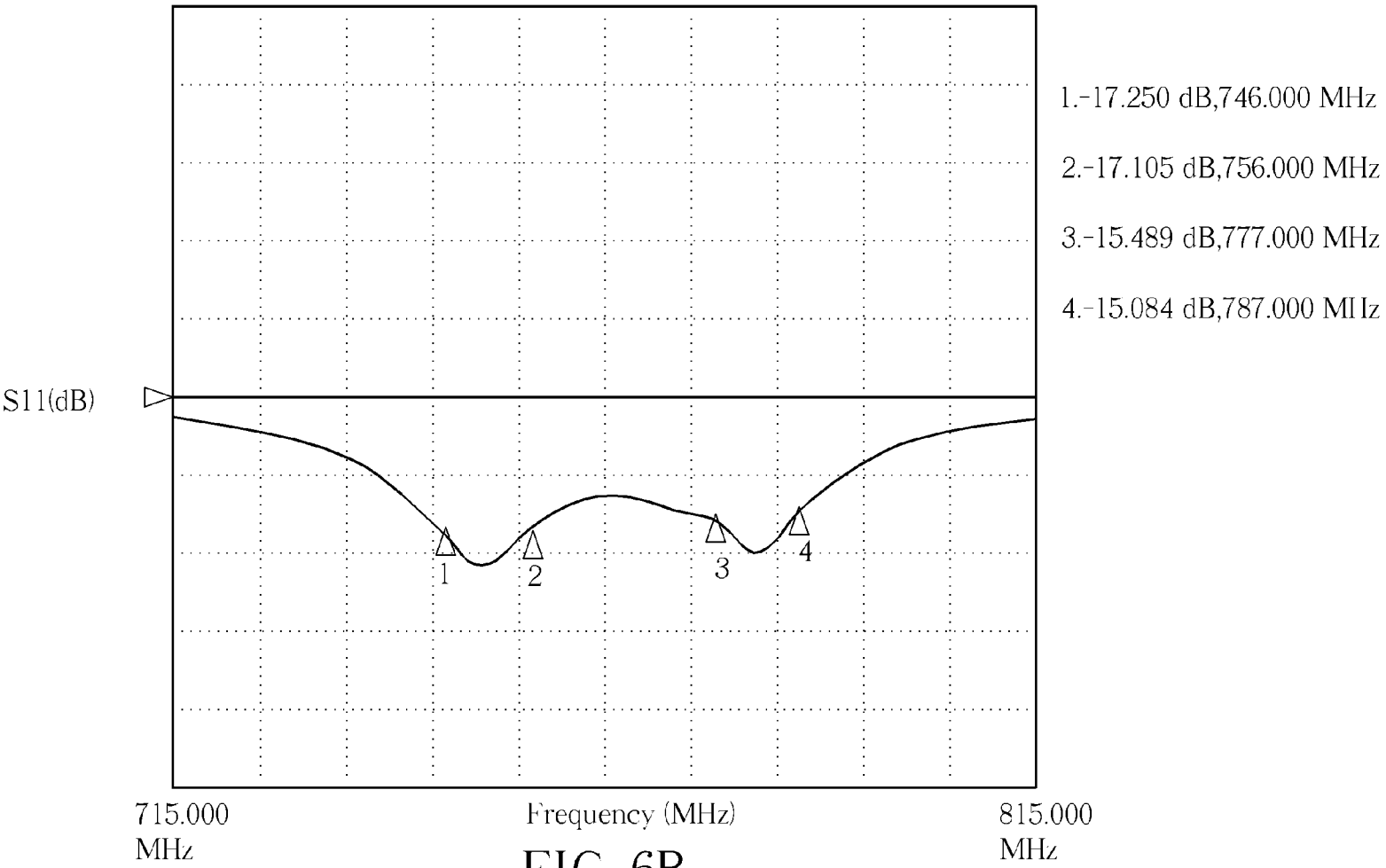
FIG. 6B is a schematic diagram of antenna resonance simulation results of the planar dual polarization antenna of the present invention for a 135-degree slant polarization.
Figure 7:
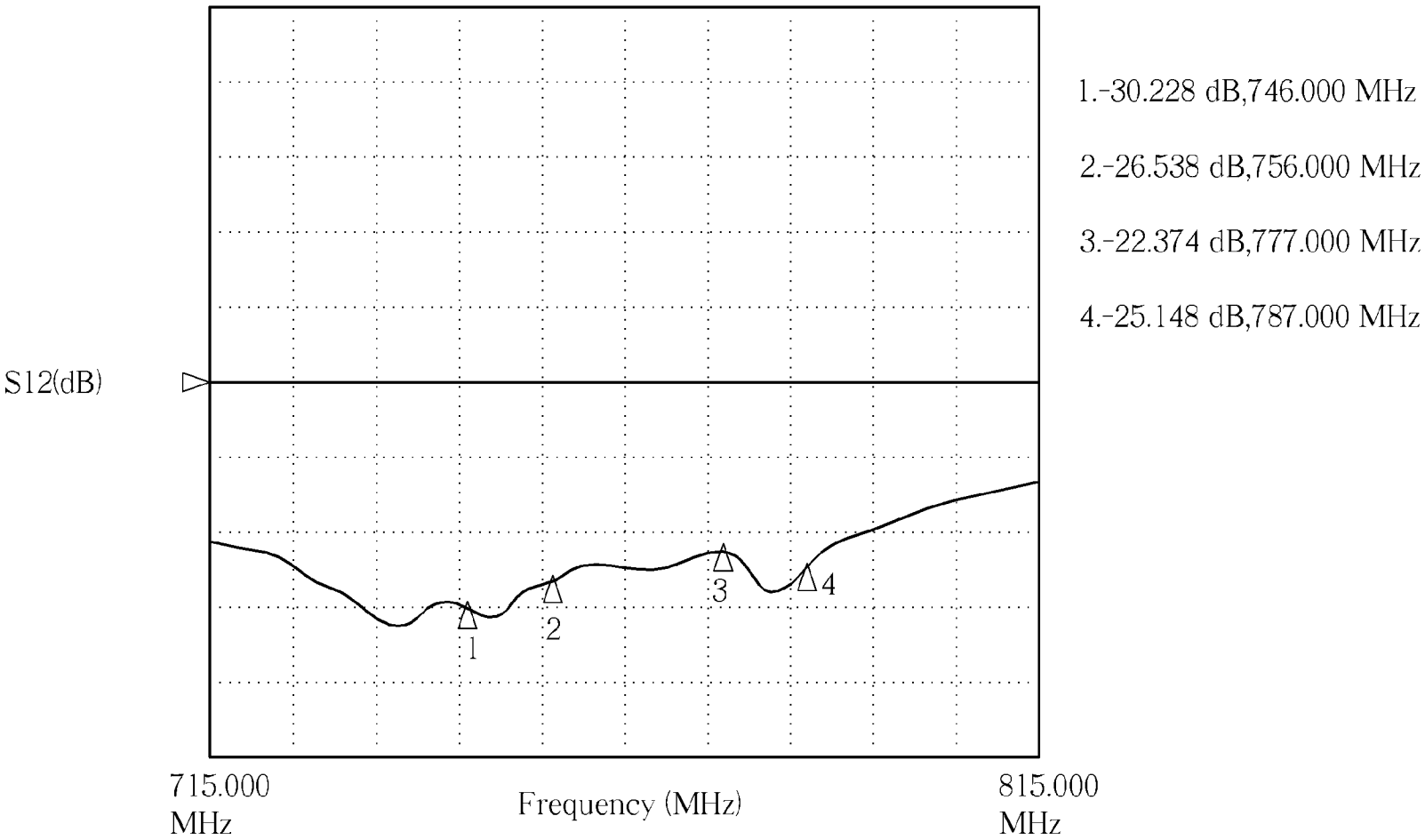
FIG. 7 is a schematic diagram of antenna isolation simulation results of the planar dual polarization antenna of the present invention for 45-degree slant polarization and 135-degree slant polarization.
Figure 8A:
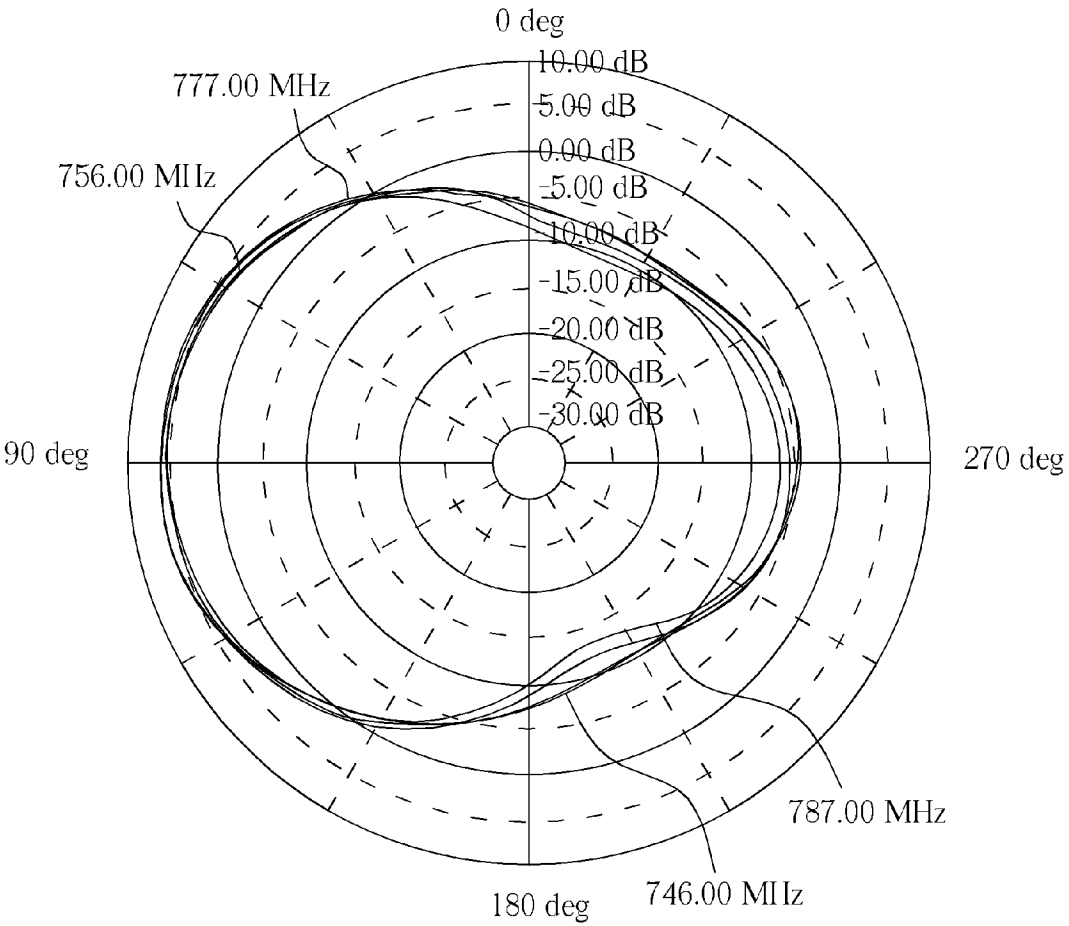
FIG. 8A is a schematic diagram of common polarization field pattern simulation results of the planar dual polarization antenna of the present invention for 45-degree slant polarization on a vertical plane.
Figure 8B:
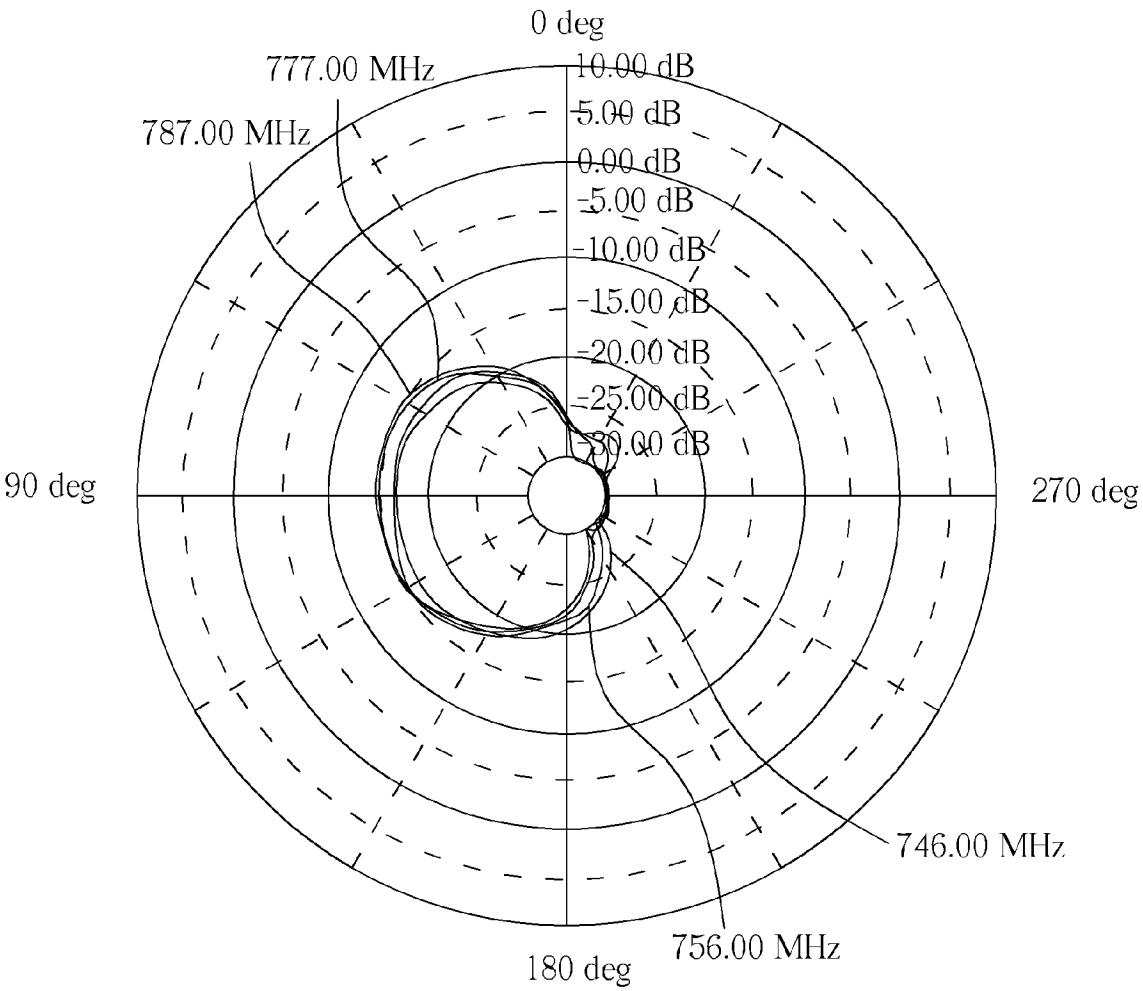
FIG. 8B is a schematic diagram of cross polarization field pattern simulation results of the planar dual polarization antenna of the present invention for 45-degree slant polarization on the vertical plane.
Figure 9A:
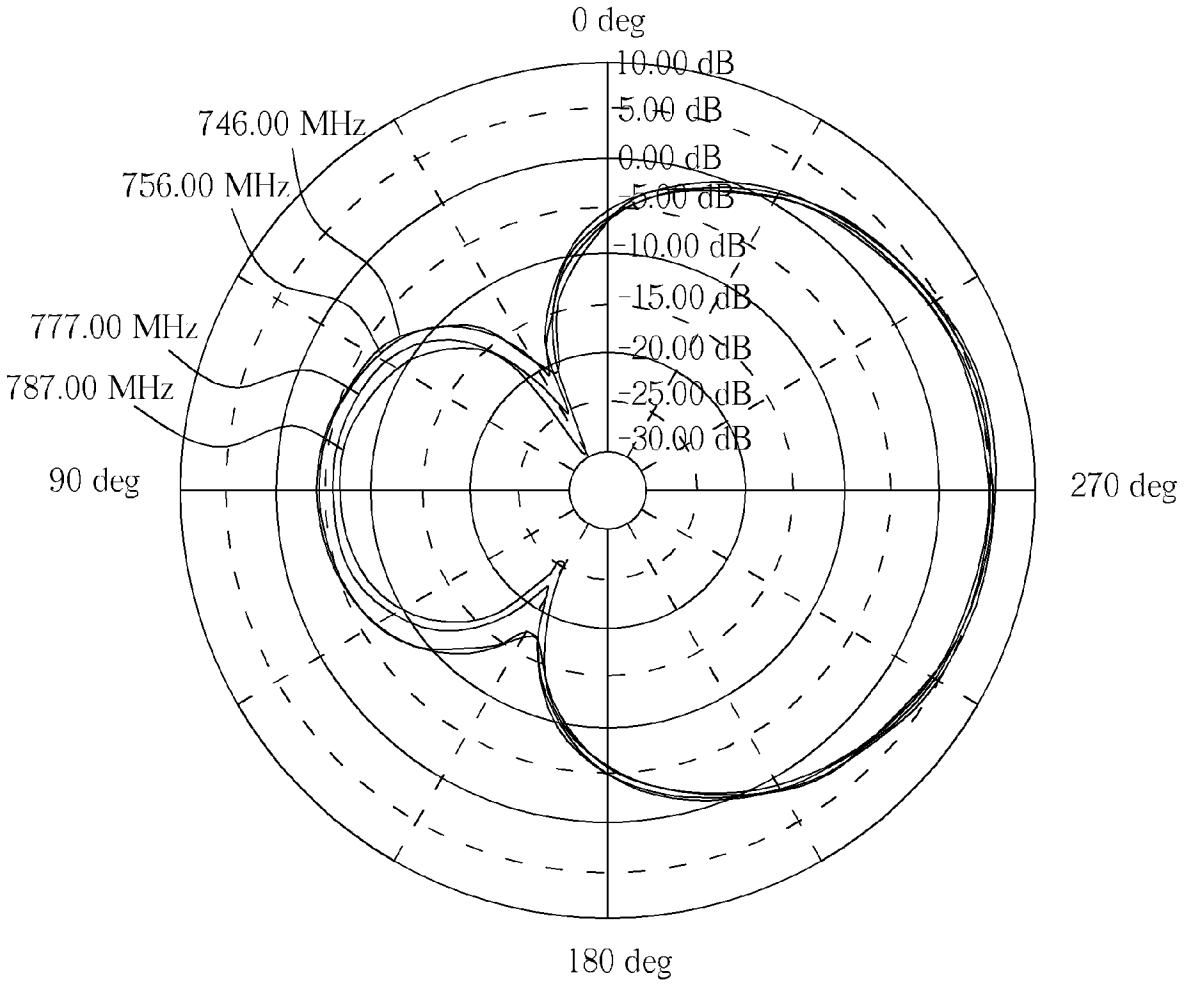
FIG. 9A is a schematic diagram of common polarization field pattern simulation results of the planar dual polarization antenna of the present invention for 45-degree slant polarization on a horizontal plane.
Figure 9B:
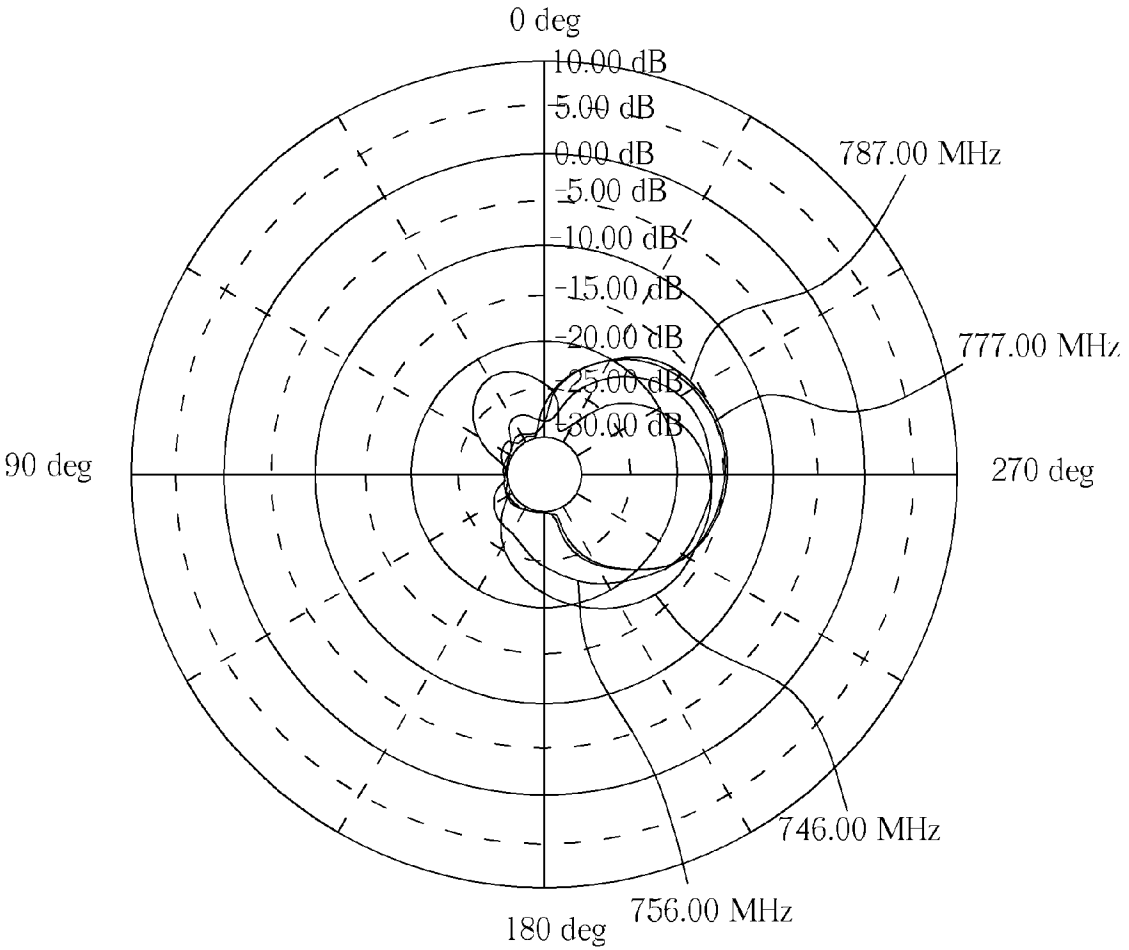
FIG. 9B is a schematic diagram of cross polarization field pattern simulation results of the planar dual polarization antenna of the present invention for 45-degree slant polarization on the horizontal plane.
Figure 10A:
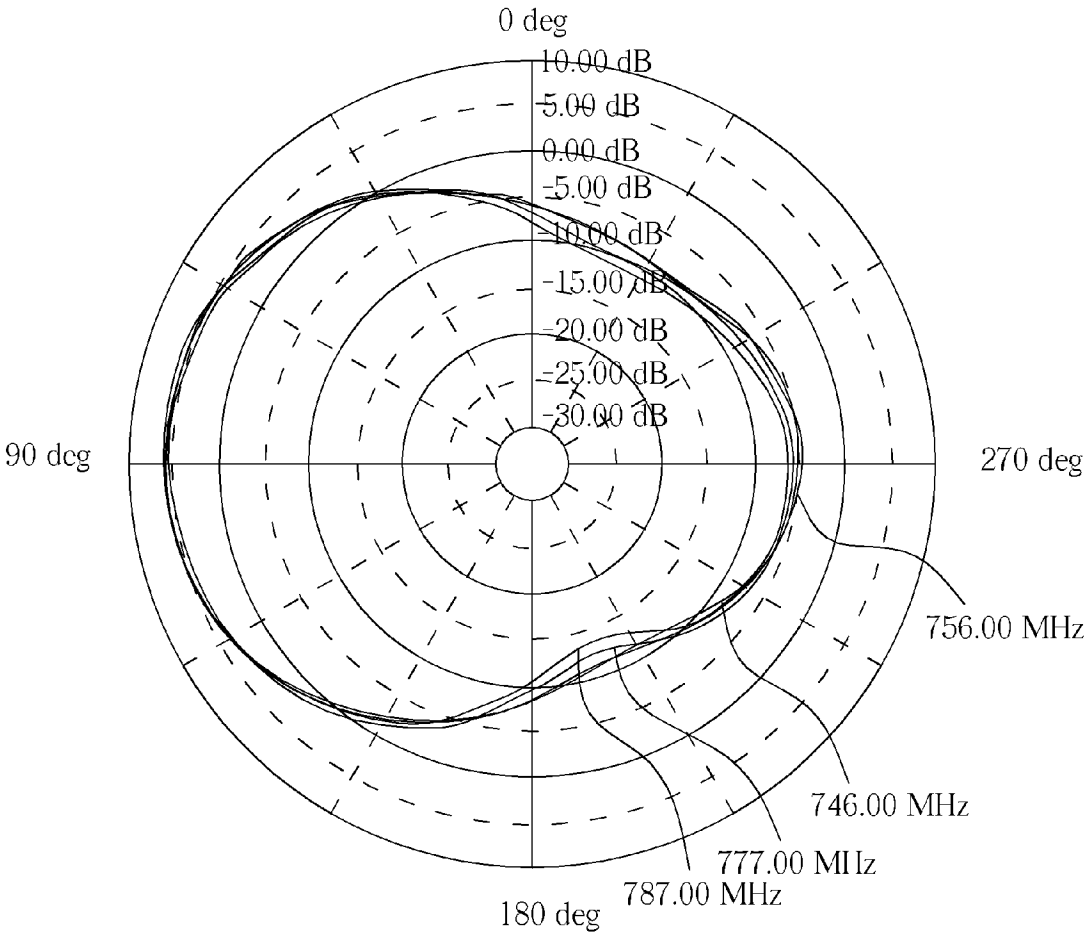
FIG. 10A is a schematic diagram of common polarization field pattern simulation results of the planar dual polarization antenna of the present invention for 135-degree slant polarization on the vertical plane.
Figure 10B:
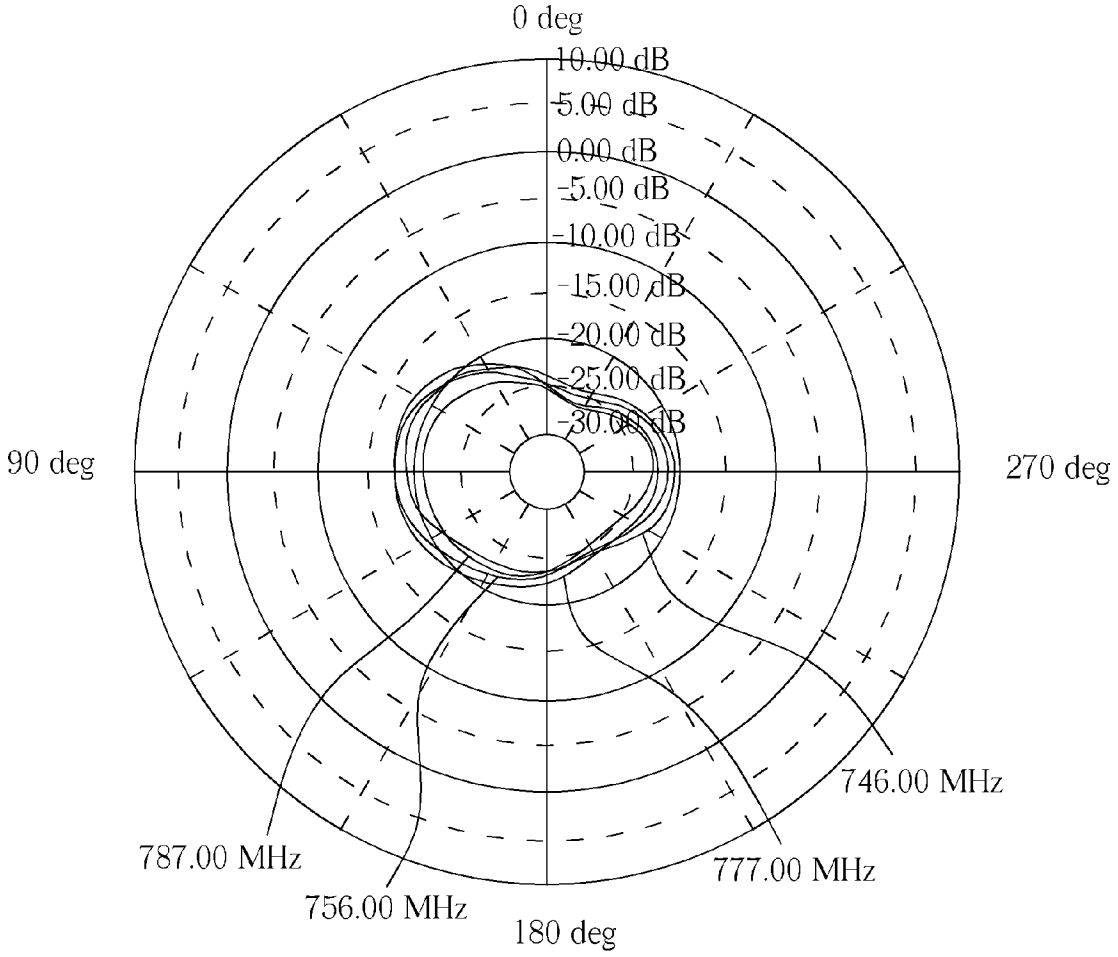
FIG. 10B is a schematic diagram of cross polarization field pattern simulation results of the planar dual polarization antenna of the present invention for 135-degree slant polarization antenna on the vertical plane.
Figure 11A:
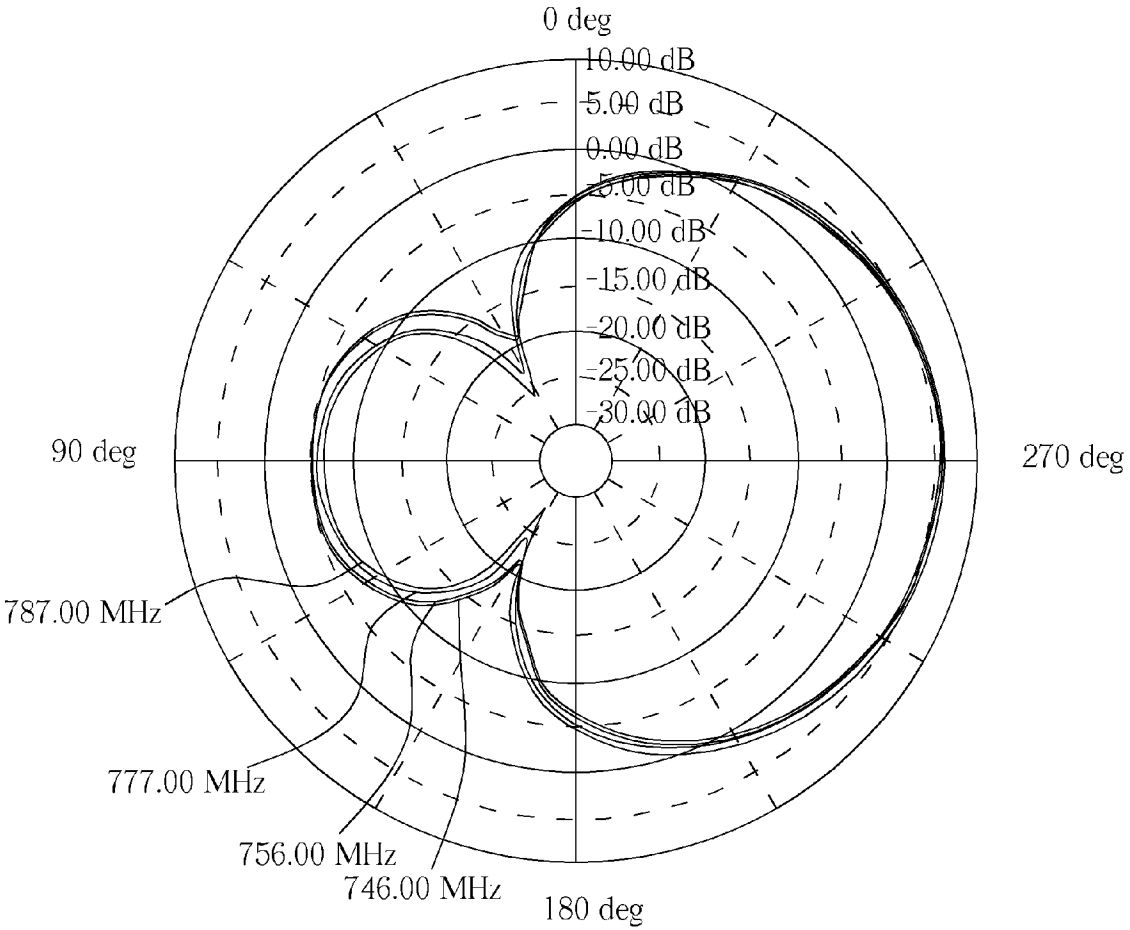
FIG. 11A is a schematic diagram of common polarization field pattern simulation results of the planar dual polarization antenna of the present invention for 135-degree slant polarization on the horizontal plane.
Figure 11B:
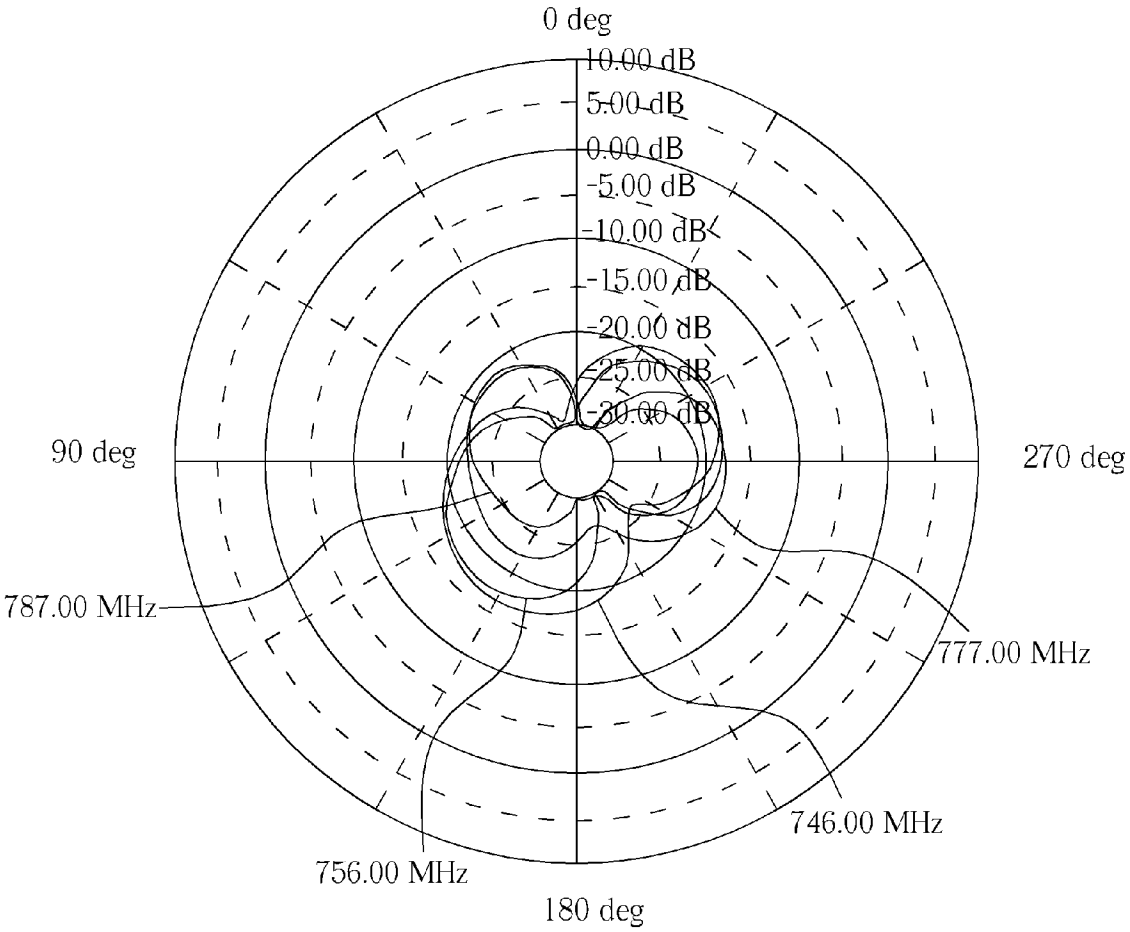
FIG. 11B is a schematic diagram of cross polarization field pattern simulation results of the planar dual polarization antenna of the present invention for 135-degree slant polarization on the horizontal plane.

Furthermore, it is possible to use the embodiment of FIG. 3G to test simulation results of the planar dual polarization antenna 20, and obtain: FIG. 6A, antenna resonance simulation results for 45-degree slant polarization; FIG. 6B, antenna resonance simulation results for 135-degree slant polarization; FIG. 7, antenna isolation simulation results for 45-degree slant polarization and 135-degree slant polarization; FIG. 8A, common polarization field pattern simulation results for 45-degree slant polarization on the vertical plane; FIG. 8B, cross polarization field pattern simulation results for 45-degree slant polarization on the vertical plane; FIG. 8C, field pattern simulation results for 45-degree slant polarization on the vertical plane; FIG. 9A, common polarization field pattern simulation results for 45-degree slant polarization on the horizontal plane; FIG. 9B, cross polarization field pattern simulation results for 45-degree slant polarization on the horizontal plane; FIG. 9C, field pattern simulation results for 45-degree slant polarization on the horizontal plane; FIG. 10A, common polarization field pattern simulation results for 135-degree slant polarization on the vertical plane; FIG. 10B, cross polarization field pattern simulation results for 135-degree slant polarization on the vertical plane; FIG. 10C, field pattern simulation results for 135-degree slant polarization on the vertical plane; FIG. 11A, common polarization field pattern simulation results for 135-degree slant polarization on the horizontal plane; FIG. 11B, cross polarization field pattern simulation results for 135-degree slant polarization on the horizontal plane; and FIG. 11C, field pattern simulation results for 135-degree slant polarization on the horizontal plane.

It can be known from the above-mentioned simulation results that the planar dual polarization antenna 20 of the present invention indeed fulfills LTE wireless communication system requirements.

In summary, the present invention utilizes patch plates with shapes substantially conforming to cross patterns, such that the directions of resonance are changed to along diagonals of the square shape. This reduces dimensions of the antenna to 0.7 times of the original while meeting 45-degree slant polarization requirements, generates linearly polarized electromagnetic waves, and provides two symmetric feed-in points to generate an orthogonal dual-polarized antenna pattern. Furthermore, it is possible add an extra patch plate on the cross-shaped patch plate of the present invention to further increase resonance bandwidth.

Those skilled in the art will readily observe that numerous modifications and alterations of the device and method may be made while retaining the teachings of the invention.

What is claimed is:

1. A planar dual polarization antenna, for receiving/transmitting radio signals, comprising:
   - a ground metal plate;
   - a first dielectric board, formed on the ground metal plate;
   - a first patch plate, formed on the first dielectric board, the first patch plate having a shape substantially conforming to a cross pattern; and
   - a second patch plate, formed on the first patch plate, and not in contact with the first patch plate.

2. The planar dual polarization antenna of claim 1, further comprising a supporting element, disposed between the second patch plate and the first patch plate or the first dielectric board, for supporting the second patch plate such that the second patch plate does not come in contact with the first patch plate.

3. The planar dual polarization antenna of claim 1, wherein the second patch plate comprises at least a bend, for supporting the second patch plate, such that the second patch plate is in contact with the first dielectric board but not in contact with the first patch plate.

4. The planar dual polarization antenna of claim 1, wherein a shape of the second patch plate is related to a shape of the first patch plate.

5. The planar dual polarization antenna of claim 1, further comprising a second dielectric board, formed between the second patch plate and the first patch plate, for separating the second patch plate and the first patch plate.

6. A planar dual polarization antenna, for receiving/transmitting radio signals, comprising:
   - a ground metal plate;
   - a first dielectric board, formed on the ground metal plate; and
   - a first patch plate, formed on the first dielectric board, the first patch plate having a shape substantially conforming to a cross pattern and two symmetric feed-in points.

7. The planar dual polarization antenna of claim 6, further comprising a second patch plate, formed on the first patch plate, and not in contact with the first patch plate.

8. The planar dual polarization antenna of claim 7, further comprising a supporting element, disposed between the second patch plate and the first patch plate or the first dielectric board, for supporting the second patch plate such that the second patch plate does not come in contact with the first patch plate.

9. The planar dual polarization antenna of claim 7, wherein the second patch plate comprises at least a bend, for supporting the second patch plate, such that the second patch plate is in contact with the first dielectric board but not in contact with the first patch plate.

10. The planar dual polarization antenna of claim 7, wherein a shape of the second patch plate is related to a shape of the first patch plate.

11. The planar dual polarization antenna of claim 7, further comprising a second dielectric board, formed between the second patch plate and the first patch plate, for separating the second patch plate and the first patch plate.

* * * * *